US007000912B2

(12) United States Patent
Tamura et al.

(10) Patent No.: US 7,000,912 B2
(45) Date of Patent: Feb. 21, 2006

(54) SHEET FINISHER WITH EJECTION ROLLER CONTROL

(75) Inventors: Hitoshi Tamura, Hachioji (JP); Hiroto Ito, Hachioji (JP); Nobutaka Kato, Higashikurume (JP); Hirohiko Okabe, Tokorozawa (JP)

(73) Assignee: Konica Corporation, Tokyo (JP)

( * ) Notice: Subject to any disclaimer, the term of this patent is extended or adjusted under 35 U.S.C. 154(b) by 37 days.

(21) Appl. No.: 10/928,530

(22) Filed: Aug. 26, 2004

(65) Prior Publication Data

US 2005/0023742 A1 Feb. 3, 2005

Related U.S. Application Data

(62) Division of application No. 10/365,326, filed on Feb. 11, 2003, now Pat. No. 6,889,971.

(30) Foreign Application Priority Data

Feb. 21, 2002 (JP) ..... 2002-044436
Feb. 28, 2002 (JP) ..... 2002-053365
Feb. 28, 2002 (JP) ..... 2002-053366

(51) Int. Cl.
*B65H 37/04* (2006.01)

(52) U.S. Cl. ..... 270/58.11; 270/58.08; 270/32; 399/410

(58) Field of Classification Search ..... 270/58.11, 270/58.13, 58.08, 58.12, 37, 32; 399/410; 493/416, 436; 271/242, 246
See application file for complete search history.

(56) References Cited

U.S. PATENT DOCUMENTS 5,382,011 A 1/1995 Tani
5,709,376 A 1/1998 Ushirogata
6,022,011 A 2/2000 Hirose
6,145,825 A 11/2000 Kunihiro et al.
6,241,234 B1 * 6/2001 Saitoh et al. ..... 270/58.12
6,305,681 B1 * 10/2001 Watanabe et al. ..... 270/58.08
6,371,472 B1 4/2002 Miyake et al.
6,427,997 B1 * 8/2002 Hirota et al. ..... 270/58.12

FOREIGN PATENT DOCUMENTS

JP 59-43765 A 3/1984
JP 60-183461 A 9/1985
JP 60-248563 A 12/1985
JP 62-68973 U 4/1987
JP 04-064577 A 2/1992

(Continued)

*Primary Examiner*—Patrick Mackey
(74) *Attorney, Agent, or Firm*—Frishauf, Holtz, Goodman & Chick, P.C.

(57) ABSTRACT

A sheet finisher includes a conveyance member which conveys a sheet to an ejection direction, a sheet ejection section having paired rollers for ejecting the conveyed sheet by nipping the sheet by the paired rollers, and a control section for controlling the conveyance member and the sheet ejection section to separate the paired rollers from each other when conveying the sheet. After a front end portion of the sheet in the ejection direction passes a nipping position of the paired rollers, the control section makes the paired rollers press-contact with each other, nip and reconvey the sheet, and eject the sheet out of the finisher. The control section further controls the conveyance member and the sheet ejection section to temporarily release the press-contact of the paired rollers during reconveyance of the sheet to remove a sag from the sheet to then make the paired rollers press-contact with each other again, and to eject the sheet out of the finisher by nipping the sheet.

21 Claims, 19 Drawing Sheets

FOREIGN PATENT DOCUMENTS

| | | | | |
|---|---|---|---|---|
| JP | 05305786 | A | * | 11/1993 |
| JP | 07228412 | A | * | 8/1995 |
| JP | 07252011 | A | * | 10/1995 |
| JP | 10-310316 | A | | 11/1998 |
| JP | 2001-247242 | A | | 9/2001 |
| JP | 2001-261220 | A | | 9/2001 |
| JP | 2001261220 | A | * | 9/2001 |
| JP | 2002193515 | A | * | 7/2002 |

* cited by examiner

37D
S
c
35A
35B
(2)
N1
33A
33B
31B
(1)
31A
34
35C
N2
d
(3)
PS2
e
39
39D
35D
(4)
41
42B
42A
PS3

SHEET FINISHER WITH EJECTION ROLLER CONTROL

CROSS-REFERENCE TO RELATED APPLICATION

The present application is a divisional application of U.S. application Ser. No. 10/365,326, filed Feb. 11, 2003 now U.S. Pat. No. 6,889,971.

BACKGROUND OF THE INVENTION

1. Field of the Invention

The present invention relates to a sheet finisher, sheet processing apparatus and image forming system that perform Z-folding, stapling or the like to a sheet on which an image is recorded by an image forming apparatus, such as electrophotographic copying machine, printer, facsimile machine, complex machine having these functions, or the like, and to methods for the same.

2. Description of Related Art

Recently, finishers which enable filing sheets by performing punching holes, two-folding, Z-folding to image recording sheets on which images are formed by image forming apparatuses, such as copying machine, printer, complex machine of these, and the like, have been provided.

In earlier technology, as sheet containing apparatuses for containing sheets ejected out from image forming apparatuses in a tray and stapling the sheets, the ones disclosed in the Japanese Patent Laid-Open Publications Nos. 59-43765, 60-183461, and 60-248563, respectively, have been known.

Further, as apparatuses for Z-folding sheets, the ones disclosed in the Japanese Utility-model Laid-Open Publication No. 62-68973, the Japanese Patent Laid-Open Publication No. 4-64577 and the like have been known.

As a sheet finisher for carrying out stapling after Z-folding sheets ejected out from an image forming apparatus, the one is disclosed in the Japanese Patent Laid-Open Publication No. 2001-261220.

In the sheet finishers for performing Z-folding and stapling in the earlier technology, there are some problems as follows.

In the sheet finishers in the earlier technology, the sheets ejected out from an image forming apparatus are stacked and adjusted on a sheet placing table, and then stapled. Thereafter, the sheets are ejected out from the sheet finishers. Then, in order to adjust the sheets sent on the sheet placing table, for example, in the Japanese Patent Laid-Open Publication No. 59-43765, a method such that an impeller-like paddle wheel is rotated in one direction is adopted.

However, in this method, the sheets fed onto the sheet placing table from conveyance rollers reach the paddle wheel by sliding down along the sheet placing table arranged to be inclined in a free state. Therefore, skew is easily caused, so that there is a problem that a certain adjustment cannot be performed.

Particularly, in a sheet finisher for stacking and adjusting the sheets ejected out from an image forming apparatus on a sheet placing table after Z-folding, and then carrying out stapling, the overlapped portion of a Z-folded sheet is swollen, and when a plurality of Z-folded sheets are stacked, the swell of the sheets increases, and the inclined sheets are curved, bent or the like by bowing. Therefore, there occurs a problem that a certain adjustment cannot be performed. The cause of the bowing of the sheets is more remarkable as the inclination of the sheet placing table is made steep.

Further, if there is swell in the sheet overlapped portion in a stack of stapled sheets stacked on the sheet placing table, the front end portion of the stack of sheets in the ejection direction comes apart when the Z-folded sheets are ejected by being conveyed along the sheet placing table after being stapled and by being nipped by sheet ejection rollers. Thereby, the stack of sheets is difficult to be nipped by the rotating sheet ejection rollers, so that bad ejection of sheets is caused.

FIG. 18 is a cross sectional view showing an ejecting state of a stack of Z-folded sheets Sa in a sheet finisher in earlier technology.

The rear end portion of the stack of Z-folded and stapled sheets Sa in the ejection direction is supported by an ejection claw 131A fixed to a turning ejection belt 131 in an accumulation section 130, and conveyed along a sheet placing table 120 arranged to be inclined. The front end portion of the stack of sheets Sa in the ejection direction reaches the nipping position between a driven roller 111 and a driving roller 112 in a sheet ejection section 110. Since the driven roller 111 and the driving roller 112 are waiting in a closed state, the front end portion of the stack of sheets Sa hits the construction member of the sheet ejection section 110, so that the rear end portion of the stack of sheets Sa is pushed upward by the ejection claw 131A which is moving forward. Therefore, buckling occurs in the vicinity of the rear end portion of the stack of sheets Sa, and moreover, tears of sheet occur in the vicinity of a portion stapled by a stapling member 140, which is in the vicinity of the rear end portion of the stack of sheets Sa, when the ejection claw 131A moves along the ejection belt 131 so as to move away from the sheet placing table 120.

Further, FIG. 19 is a cross sectional view showing an ejecting state of a stack of Z-folded sheets Sa in another sheet finisher in the earlier technology.

The rear end portion of the stack of Z-folded and stapled sheets Sa in the ejection direction is supported by an ejection claw 231A fixed to a turning ejection belt 231 in an accumulation section 230, and conveyed along a sheet placing table 220 arranged to be inclined. The front end portion of the conveyed stack of sheets Sa passes through a sheet ejection opening such that a driving roller 212 and a driven roller 211 in a sheet ejection section 210 are separated from each other so as to be in an open state. After the front end portion of the stack of sheets Sa passes through the sheet ejection opening, the driven roller 211 comes down toward the driving roller 212 side, and press-contacts the upper surface of the stack of sheets Sa. Then, the stack of sheets Sa is nipped by the rotating driving roller 212 and the driven roller 211 driven to be rotated via the stack of sheets Sa, and then ejected.

When ejecting the stack of sheets Sa by press-contacting and nipping the front end of the Z-folded portion of the stack of sheets Sa, sag is generated, and at the time of ejecting the stack of sheets Sa, slip occurs between the driven roller 211 and the upper surface of the stack of sheets Sa, so that sag is generated in the vicinity of the front end portion of the Z-folded portion of the stack of sheets Sa. This sag increases during the ejection of the stack of sheets Sa, and therefore, wrinkles are generated in the vicinity of two staples SP in the vicinity of the rear end portion of the stack of sheets Sa, which are stapled by a stapling member 240.

SUMMARY OF THE INVENTION

The present invention was made in view of the above problems. An object of the present invention is to provide a sheet finisher, sheet processing apparatus, and image forming system for adjusting certainly and stapling sheets ejected out from an image forming apparatus or the like on a sheet placing member, and to provide methods for the same.

Further, another method of the present invention is to provide a sheet finisher, sheet processing apparatus, and image forming system for conveying certainly a sheet ejected from an image forming apparatus or the like, and ejecting certainly the sheet without generating buckling, wrinkle, tear and the like, and to provide methods for the same.

In order to achieve the above-described object, according to a first aspect of the present invention, the sheet finisher of the present invention comprises: a sheet placing member for placing and adjusting a predetermined number of sheets to which a predetermined processing is carried out thereon; a stapling member for stapling the predetermined number of adjusted sheets; and an air-blowing member arranged above the sheet placing member, wherein the air-blowing member is operated to press each of the sheets against the sheet placing member by blowing air and adjust when each of the sheets to which the predetermined processing is carried out is placed on the sheet placing member, and stapling is performed to the sheets by the stapling member.

According to the sheet finisher of the present invention, the airflow of the air-blowing member presses the sheet surface when a plurality of sheets to which a predetermined processing is carried out are stacked on the sheet placing member. Thereby, the sheets on the sheet placing member are prevented from being curved, bent or the like by bowing, so that the sheets are adjusted certainly.

In the sheet finisher, preferably, the air-blowing member is supported oscillatably, and the air-blowing member is capable of opening and closing a sheet conveyance path above the sheet placing member. Further, the air-blowing member is preferable to be arranged in a vicinity of a middle portion of a length of the sheets in a conveyance direction, and arranged in the vicinity of a middle portion of the sheets in a width direction perpendicular to the conveyance direction, the sheets to which the predetermined processing is carried out being placed on the sheet placing member.

Further, the sheet finisher may further comprise: a control section for controlling air blowing of the air-blowing member, and preferably, the control section controls to start the air blowing when a first sheet to which the predetermined processing is carried out is conveyed to the sheet placing member, and to stop the air blowing when the stapled sheets are ejected out from the sheet placing member after stapling is performed to the predetermined number of the sheets. Accordingly, the first sheet can be prevented from being adhered to the sheet placing member by being pressed on the sheet placing member by the blown air. Moreover, the control section may make an amount of air blowing according to the air-blowing member vary in accordance with the number of the sheets to which the predetermined processing is carried out, the sheets being placed sequentially on the sheet placing member.

Further, an image may be formed on the sheets before the predetermined processing is performed. The "predetermined processing" in the specification is a finishing processing including punching holes, two-folding, Z-folding, three-folding and the like. Moreover, the stapling may include end-stapling, midway stapling and the like. Particularly, when the midway stapling is performed to the sheets, midway folding is preferable to be performed to the sheets after the midway stapling is performed. Further, the sheet placing member may comprise an inclined surface, and the sheets may be placed on the inclined surface.

Furthermore, preferably, the air-blowing member is operated when the stapled sheets are conveyed along the sheet placing member in a direction for ejecting the stapled sheets out of the finisher so as to make the sheets flat by blowing air. Accordingly, the airflow of the air-blowing member presses the sheet surface when the sheets whose overlapped portion is swollen, and the like, are conveyed along the sheet placing member toward the ejection direction. Thereby, variation in the front end portion of the stapled sheets in the ejection direction that moves along the sheet placing member is reduced to make the sheets flat. Therefore, the front end portion of the stapled sheets is certainly nipped and ejected by, for example, sheet ejection paired rollers or the like which eject the sheets by rotating, so that bad ejection of sheets will be resolved.

Further, according to a second aspect of the present invention, the sheet finisher of the present invention comprises: a conveyance member for conveying a sheet to an ejection direction; a sheet ejection section having paired rollers, for ejecting the conveyed sheet by nipping the sheet by the paired rollers; and a control section for controlling the conveyance member and the sheet ejection section to make the paired rollers in a half-open state when conveying the sheet, and after a front end portion of the sheet in the ejection direction passes a nipping position of the paired rollers, temporarily stop conveying the sheet by the conveyance member, make the paired rollers press-contact with each other, nip and re-convey the sheet, and eject the sheet out of the finisher. Here, a position of the sheet to temporarily stop on the sheet placing member is preferable to be a position such that an air pressure of the air-blowing member acts on a rear end portion of the sheet in the ejection direction.

According to the sheet finisher of the present invention, since the paired rollers are made to wait in a half-open state when the sheet is ejected from the sheet ejection section, buckling, wrinkle, tears or the like caused by the front end portion of the sheet in the ejection direction hitting the construction members of the sheet ejection section, such as paired rollers or the like, can be prevented from being generated. Further, after the front end portion of the sheet in the ejection direction has passed the nipping position of the paired rollers, the sheet conveyance is stopped temporarily, and thereafter, the paired rollers are made to press-contact with each other and the sheet is re-conveyed and ejected out of the finisher. Therefore, sag or the like in the sheet according to a slip between the paired rollers and the sheet, or the like, can be prevented from being generated. Particularly, in case that the conveyance member has a construction such that the conveyance member supports the rear end portion of the sheet in the ejection direction to convey and eject the sheet from the sheet ejection section, buckling, wrinkle, tears or the like of the sheet in the vicinity of the rear end portion of the sheet according to the conveyance member, which is moving forward, pushing the rear end portion of the sheet upward can be prevented from being generated. Therefore, the sheet will be certainly ejected out from the sheet ejection section.

In addition, the "half-open state" in the specification means a state that between the paired rollers is opened enough to pass the sheet, which is conveyed by the conveyance member.

In the sheet finisher, preferably, the control section further controls the conveyance member and the sheet ejection section to temporarily release the press-contact of the paired rollers during re-conveyance of the sheet, and after removing a sag of the sheet during the conveyance, make the paired rollers press-contact with each other again, and to eject the sheet out of the finisher by nipping the sheet. Accordingly, sag of the sheet ejected by the paired rollers is prevented from increasing, so that the sheet can be certainly ejected from the sheet ejection section.

Further, the paired rollers may comprise a first roller for rotating by being connected to a driving source, and a second roller for rotating by press-contacting with the first roller. Preferably, the second roller is driven by a press-contact drive mechanism, such as solenoid or the like, so as to be capable of contacting with and separating form the first roller side to press-contact and release the sheet.

The sheet finisher may further comprise: a sheet placing member for placing and adjusting a predetermined number of sheets to which a predetermined processing is carried out thereon; and a stapling member for stapling the predetermined number of the adjusted sheets. In this case, the stapled sheets are conveyed to the ejection direction along the sheet placing member by the conveyance member.

Further, in the sheet finisher, the air-blowing member in the above-described first aspect may be arranged above the sheet placing member. In this case, a position of the sheet to temporarily stop is preferable to be a position such that a front end portion of the sheet in the ejection direction is projected more forward than the nipping position of the sheet of the paired rollers in the sheet ejection direction.

Furthermore, according to a third aspect of the present invention, the sheet processing apparatus of the present invention comprises: a sheet folding apparatus for carrying out a predetermined processing to a sheet; and the sheet finisher in the above-described first aspect of the present invention, for adjusting and stapling the predetermined number of the sheet ejected from the sheet folding apparatus, to which the predetermined processing is carried out.

Further, according to a fourth aspect of the present invention, the sheet processing apparatus of the present invention comprises: a sheet folding apparatus for carrying out a predetermined processing to a sheet; and the sheet finisher in the above-described second aspect of the present invention, for conveying the sheet ejected from the sheet folding apparatus to the ejection direction, to which the predetermined processing is carried out.

The sheet folding apparatuses in these sheet processing apparatuses are apparatuses for performing folding, such as two-folding, Z-folding, three-folding and the like, and punching holes, and the like.

Moreover, according to a fifth aspect of the present invention, the image forming system of the present invention comprises: an image forming apparatus for forming an image on a sheet; a sheet folding apparatus for carrying out a predetermined processing on the sheet formed with the image, which is ejected from the image forming apparatus; and the sheet finisher in the above-described first aspect of the present invention, for adjusting and stapling the predetermined number of the sheet ejected out from the sheet folding apparatus, to which the predetermined processing is carried out.

Further, according to a sixth aspect of the present invention, the image forming system of the present invention comprises: an image forming apparatus for forming an image on a sheet; a sheet folding apparatus for carrying out a predetermined processing on the sheet formed with the image, which is ejected from the image forming apparatus; and the sheet finisher in the above-described second aspect of the present invention, for conveying the sheet ejected out from the sheet folding apparatus to the ejection direction, to which the predetermined processing is carried out.

In these image forming systems, the image forming apparatuses are preferable to comprise: an image writing section for writing an image on the sheet; an image forming section for forming the image on the sheet by the image writing section; a sheet conveying member for conveying the sheet; and a control section for controlling the image writing section, image forming section, and sheet conveying member.

Furthermore, according to a seventh aspect of the present invention, the sheet finishing method of the present invention comprises: placing and adjusting a sheet to which a predetermined processing is carried out on a sheet placing member; stapling a predetermined number of the adjusted sheets; and blowing air to the sheet placing member from above of the sheet placing member, wherein each of the sheets is pressed against the sheet placing member by the blown air when each of the sheets to which the predetermined processing is carried out is placed on the sheet placing member, and the sheets are adjusted and stapled.

Further, according to an eighth aspect of the present invention, the sheet finishing method of the present invention comprises: conveying a sheet to an ejection direction; and ejecting the conveyed sheet by nipping it by paired rollers, wherein the paired rollers are made in a half-open state when the sheet is conveyed, and after a front end portion of the sheet in the ejection direction passes a nipping position of the paired rollers, the sheet conveyance is temporarily stopped, and the paired rollers are press-contacted with each other, and the sheet is nipped to be re-conveyed and ejected.

Moreover, according to a ninth aspect of the present invention, the sheet processing method of the present invention comprises: carrying out a predetermined processing to a sheet; and adjusting and stapling a predetermined number of sheets to which the predetermined processing is carried out, according to the sheet finishing method in the above-described seventh aspect.

Further, according to a tenth aspect of the present invention, the sheet processing method of the present invention comprises: carrying out a predetermined processing to a sheet; and conveying the sheet to which the predetermined processing is carried out to an ejection direction, according to the sheet finishing method in the above-described eighth aspect.

Further, according to an eleventh aspect of the present invention, the image forming method of the present invention comprises: forming an image on a sheet; carrying out a predetermined processing to the sheet formed with the image; and adjusting and stapling a predetermined number of the sheets to which the predetermined processing is carried out, according to the sheet finishing method in the above-described seventh aspect.

Moreover, according to a twelfth aspect of the present invention, the image forming method of the present invention comprises: forming an image on a sheet; carrying out a predetermined processing to the sheet formed with the image; and conveying the sheet to which the predetermined processing is carried out to an ejection direction, according to the sheet finishing method in the above-described eighth aspect.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein;

FIG. 2A is a plan view showing a sheet before performing finishing processing such as folding or the like;

PREFERRED EMBODIMENT OF THE INVENTION

Next, a sheet finisher (hereinafter, it is referred to as "finisher") according to an embodiment of the present invention, and a sheet processing apparatus and image forming system comprising the finisher will be explained on the basis of drawings.

[Image Forming System]

Figure 1:
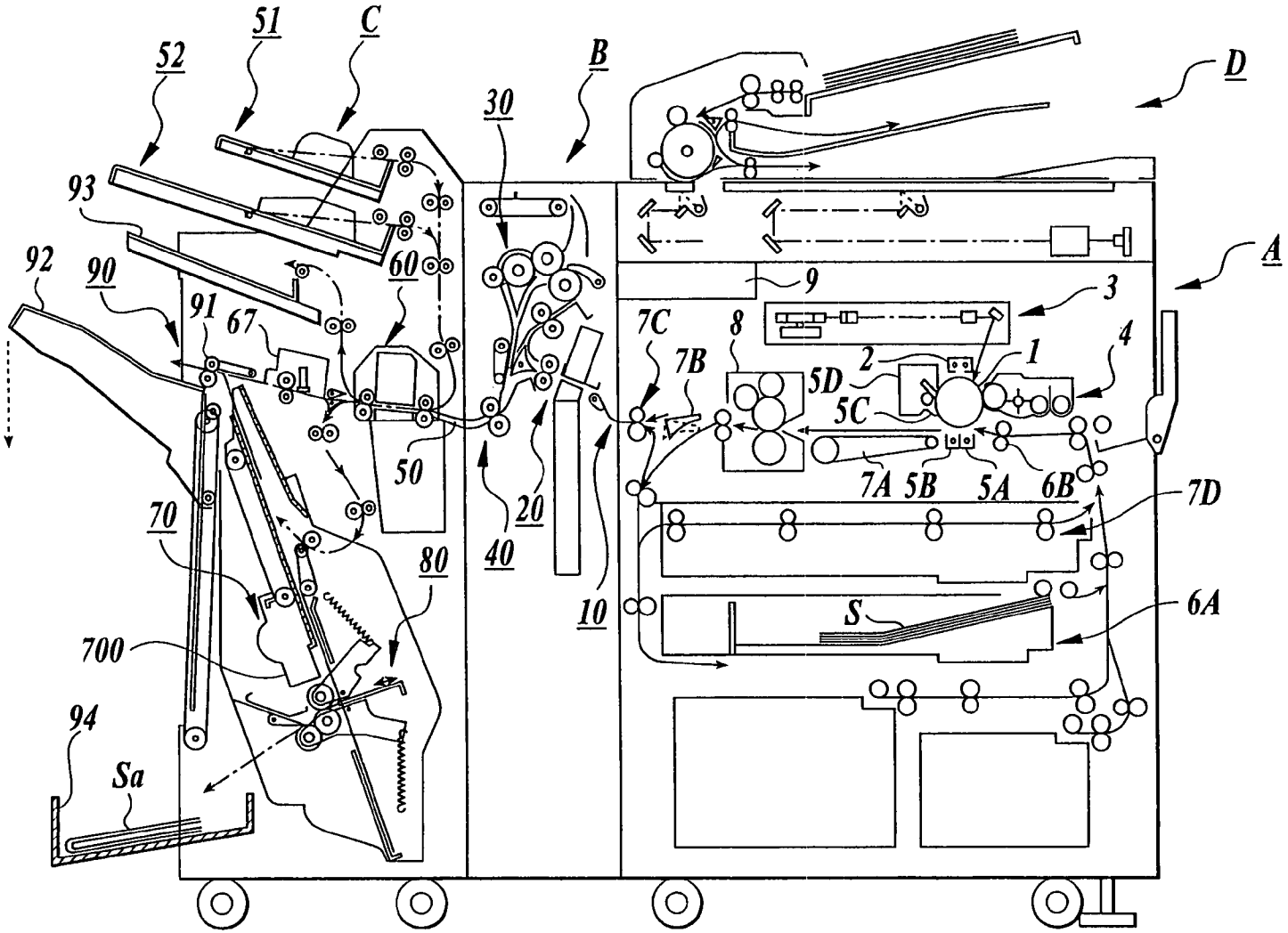
FIG. 1 is a whole construction view showing an image forming system comprising an image forming apparatus, a first finisher, and a second finisher.

FIG. 1 is a whole construction view showing the image forming system comprising an image forming apparatus A, a first finisher (sheet folding apparatus) B, a second finisher (sheet finisher) C.

[Image Forming Apparatus]

The image forming apparatus A comprises an image forming section arranging a charging member 2, an image exposing section (image writing section) 3, a developing section 4, a transfer member 5A, a charge-removing member 5B, a separation claw 5C, and a cleaning member 5D around a rotating image carrying member 1. After charging is carried out uniformly to a surface of the image carrying member 1 by the charging member 2, a latent imager is formed by exposing and scanning on the basis of image data read from a document according to a laser beam in the image exposing section 3. Then, the latent image is reversal developed by the developing section 4, and a toner image is formed on a surface of the image carrying member 1.

On the other hand, an image recording sheet (hereinafter, it is referred to as "sheet") S fed from a sheet feeding section 6A is sent to a transfer position through a intermediate sheet feeding member 6B. In the transfer position, the toner image is transferred onto the sheet S by the transfer member 5A. Thereafter, charge on the rear surface of the sheet S is eliminated by the charge-removing member 5B, and the sheet S is separated from the image carrying member 1 by the separation claw 5C. Then, the sheet S is conveyed by a conveying member (sheet conveying member) 7A, and continue to be heated and fixed by a fixing section 8, and then ejected by sheet ejection rollers 7C.

When performing image forming on both sides of the sheet S, the sheet S one side of which is heated and fixed by the fixing section 8 is diverged from an usual sheet ejection path by a conveyance path switching plate 7B, and is switched back so as to reverse the two sides in a reverse conveyance section 7D, and the other side thereof is heated and fixed by the fixing section 8. Thereafter, the sheet S is ejected out of the apparatus A by the sheet ejection rollers 7C. The sheet S ejected by the sheet ejection rollers 7C is fed into an entrance section 10 of the first finisher B.

On the other hand, the developer remained on the surface of the image carrying member 1 after the image processing is removed by the cleaning member 5D, and the image carrying member 1 prepares for the next image forming.

In the upper front side of the image forming apparatus A, an operation section 9 for selecting and setting an image forming mode and sheet finishing mode is arranged.

On the upper portion of the image forming apparatus A, an image reading device D comprising a moving original exposure reading type automatic document feeder is provided.

[Sheet Finisher]

The sheet S conveyed into the first finisher B is processed by selecting at least one processing (a predetermined processing), such as the later-described punching holes, Z-folding, midway folding, three-folding or the like, and is fed into the second finisher C. In the embodiment, the first finisher B and the second finisher C are named generically as "sheet finisher (sheet processing apparatus)".

The first finisher B comprises an entrance section 10, a first punching section 20, a first folding section 30, and a sheet ejection section 40.

In the first finisher B, the punched and finished sheet S, or the sheet S ejected from the image forming apparatus A and passed without performing these finishing processing is ejected by the sheet ejection section 40 and conveyed into an entrance section 50 of the second finisher C arranged to be adjacent to the first finisher B.

In the second finisher C, a first sheet feeding section 51, a second sheet feeding section 52, a second punching section 60, an accumulation section 70, a stapling member (staple member) 700, a second folding section 80, a shifting section 67, a sheet ejection section 90, an up-and-down sheet ejection table 92, an upper sheet ejection table 93, a lower sheet ejection table 94 and the like are arranged.

[First Finisher]

Figure 2A:
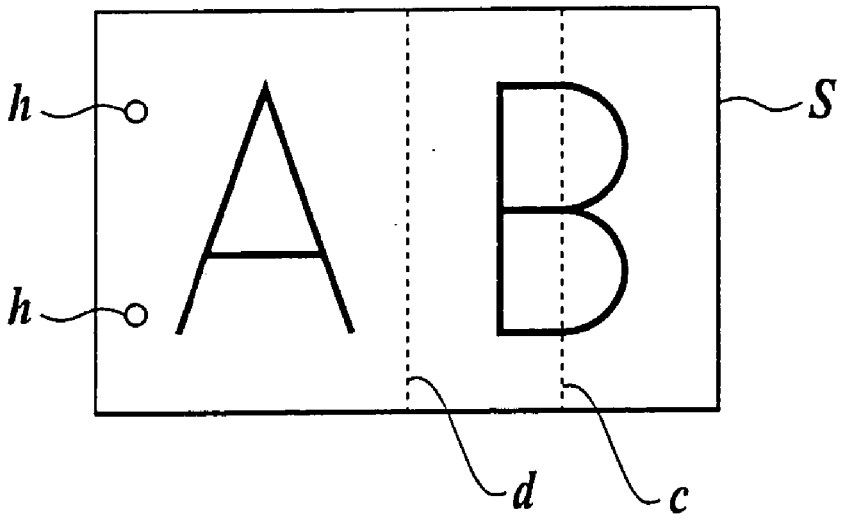
Figure 2B:
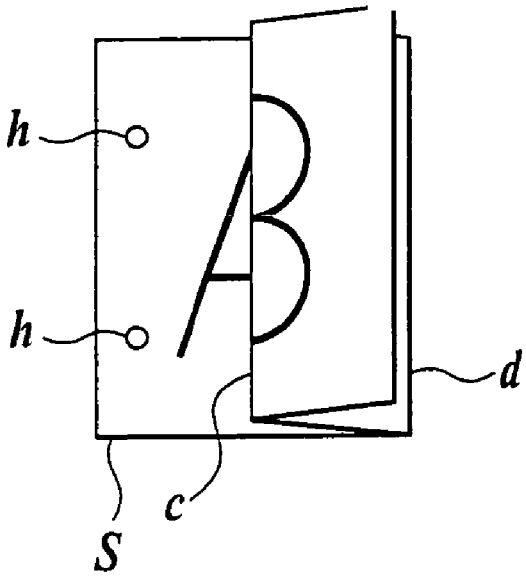
FIG. 2B is a plan view showing a sheet after being finished.

FIGS. 2A and 2B are plane views showing a sheet S before performing finishing processing, such as Z-folding or the like, and a sheet S after Z-folded. FIG. 2A is a plane view showing a sheet S before Z-folded. The character c shown by a dotted line is a first fold, and the character d is a second fold. FIG. 2B is a plane view showing a Z-folded sheet S.

In the sheet S Z-folded by the first finisher B, the first fold c and the second fold d are formed, and the sheet S is folded in a Z-shape.

Next, the construction of the first finisher B will be explained.

Figure 3:
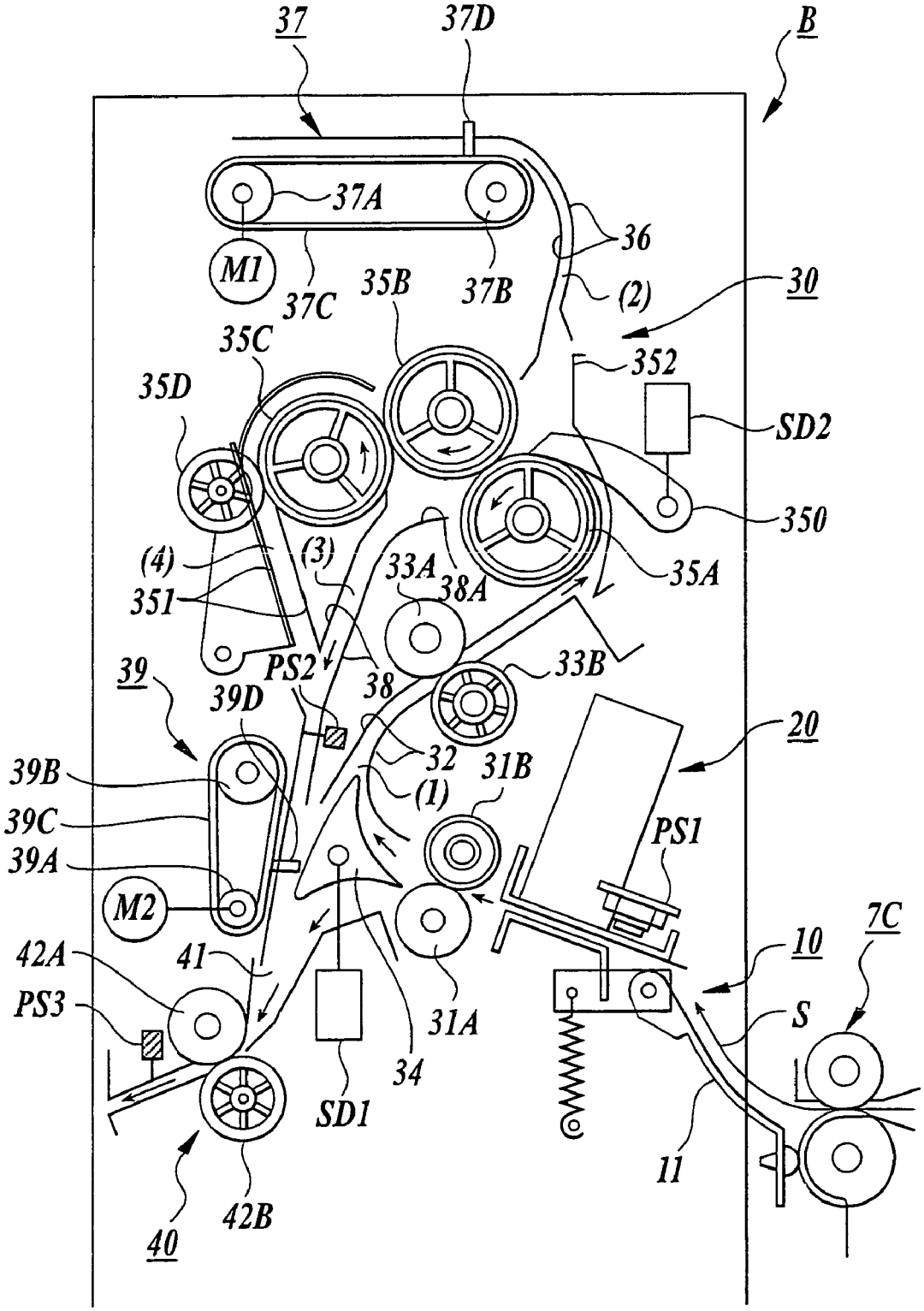
FIG. 3 is a cross sectional view showing a construction and a sheet conveyance path of the first finisher.

FIG. 3 is a cross sectional view showing a construction and a sheet conveyance path of the first finisher B.

The sheet S ejected from the sheet ejection rollers 7C of the image forming apparatus A is carried into the entrance section 10 of the first finisher B. In the entrance section 10 which forms a sheet proceeding section, an entrance guide plate 11 is supported oscillatably to the body of the finisher.

In the downstream side in sheet conveyance direction of the entrance section 10, an entrance sensor PS1 for detecting passage of the front end portion and rear end portion of the sheet S is arranged, and in its further downstream side, the first punching section 20 is arranged.

In the downstream side in sheet conveyance direction of the first punching section 20, a pair of resister rollers 31A and 31B is provided. Further, a pair of intermediate conveyance rollers 33A and 33B and a switching member 34 for switching the conveyance direction are provided in a first conveyance path (1) formed by a pair of guide plates 32. The switching member 34 is oscillated by a solenoid SD1.

In the downstream side of the first conveyance path (1), a pair of mutually press-contacting first folding rollers 35A and 35B is provided. Further, a second folding roller 35C press-contacting with the first folding roller 35B is provided. The surfaces of the first folding rollers 35A and 35B and the second folding roller 35C are made from a material having high friction resistance, such as rubber or the like.

In the downstream side in the conveyance direction of the first folding rollers 35A and 35B, a second conveyance path (2) is formed by a pair of guide plates 36 provided in both sides in the thickness direction of the sheet S. In the vicinity of the downstream side in the conveyance direction of the second conveyance path (2), a first stop section (first position regulation section) 37 is arranged.

The first stop section 37 comprises a stopper portion 37D projected to a part of a non-end belt 37C turnably winding around a driving pulley 37A and a drive pulley 37B.

The stopper portion 37D is driven by a stepping motor M1, and moves to and stops in a position selected from a plurality of predetermined positions in accordance with selection of size of processing sheet S in the sheet conveyance direction, and folding mode.

The front end of the sheet S is supported perpendicular to its proceeding direction by providing two stopper portions 37D in two portions of the sheet width direction perpendicular to the sheet conveyance direction, and the sheet S is stopped accurately.

The first folding section 30 is formed by the first folding rollers 35A and 34B, the guide plates 36, the first stop section 37 and the stepping motor M1.

Moreover, in the downstream side in the conveyance direction of the first folding rollers 35A and 35B, a third conveyance path (3) is formed by guiding plates 38 provided in both sides in thickness direction of the sheet S.

On the other hand, similarly to the first stop section 37, a second stop section (second position regulation section) 39 for stopping the sheet S by abutting the first fold c of the sheet S as a front end is also provided movably in the sheet conveyance direction in the third conveyance path (3). The second stop section 39 comprises a driving pulley 39A, a driven pulley 39B, a non-end belt 39C, a stopper portion 39D, and a stepping motor M2.

Further, in the downstream side of the nipping position of the second folding roller 35C and the driven roller 35D, a pair of guide plates 351 is provided. A fourth conveyance path (4) having a role of ejecting the sheet S that folding is completed is formed by the guide plates 351. The downstream side of the fourth conveyance path (4) meets the third conveyance path (3), and follows the second stop section 39 and the sheet ejection section 40. The sheet ejection section 40 comprises a sheet ejection path 41, and a pair of sheet ejection rollers 42A and 42B.

The numeral PS2 denotes a sheet passage sensor for detecting passage of the front end portion of the sheet S which passes through the third conveyance path (3). The numeral PS3 denotes a sheet ejection sensor for detecting sheet ejection, which is arranged in the vicinity of the sheet ejection rollers 42A and 42B.

The operation of the first finisher B having such a construction as described above, that is, the finishing processing, such as simple passing of sheet, midway folding of sheet, Z-folding of sheet, three-folding of sheet, and the like, will be explained.

(1) Simple Passing of Sheet

The switching member 34 provided in the first finisher B is rotated in counterclockwise direction in FIG. 3 by the solenoid SD1. The sheet S is conveyed from the entrance section 10 by the register rollers 31A and 31B, and guided to the sheet ejection path 41 in the sheet ejection section 40 by the switching member 34. Then, the sheet S is nipped by the sheet ejection rollers 42A and 42B, and conveyed to the second finisher C.

In case of punching holes in the sheet whose length is short in the conveyance direction, for example, the sheet S whose size is not more than A4 size, the sheet S conveyed into the entrance section 10 is made to stop temporarily when a predetermined length thereof is conveyed by the register rollers 31A and 31B and the sheet ejection rollers 42A and 42B. Then, after holes are punched in predetermined portions of the sheet S by the first punching section 20, the sheet S is conveyed by the register rollers 31A and 31B and the sheet ejection rollers 42A and 42B so as to be fed into the second finisher C.

In case of punching holes in the sheet whose length is long in the conveyance direction, for example, the sheet S whose size is not less than A4R or B4 size, the switching member 34 is oscillated by the solenoid SD1 at first, and a movable guide member 350 supported oscillatably in the vicinity of the first folding roller 35A is oscillated in the counterclockwise direction by the solenoid SD2 so as to close the second conveyance path (2).

After such a conveyance path is formed, the sheet S is conveyed by the register rollers 31A and 31B. At first, the sheet S is conveyed to the first conveyance path (1), and conveyed by the intermediate conveyance rollers 33A and 33B. Then, the sheet S is guided by the movable guide member 350, and moreover, the sheet S goes into the nipping position of the first folding rollers 35A and 35B by rotating the first folding rollers 35A and 35B in the directions shown by arrows. In a mode of punching holes in the rear end of the sheet, the stepping motor M2 is operated so as to move the second stop section 39, so that the stopper portion 39D is moved out of the third conveyance path (3).

At the timing such that the rear end of the sheet S conveyed along the third conveyance path (3) and the sheet ejection path 41 reaches the first punching section 2, the first folding rollers 35A and 35B, the register rollers 31A and 31B, and the intermediate conveyance rollers 33A and 33B are made to stop, and the first punching section 20 is operated so as to punch holes in predetermined portions of the sheet S. Thereafter, the rollers are re-rotated at once so as to convey the sheet S, and the sheet S is sent to the second finisher C by the sheet ejection rollers 42A and 42B.

(2) Z-Folding

Figures 4A, 4B, 4C:
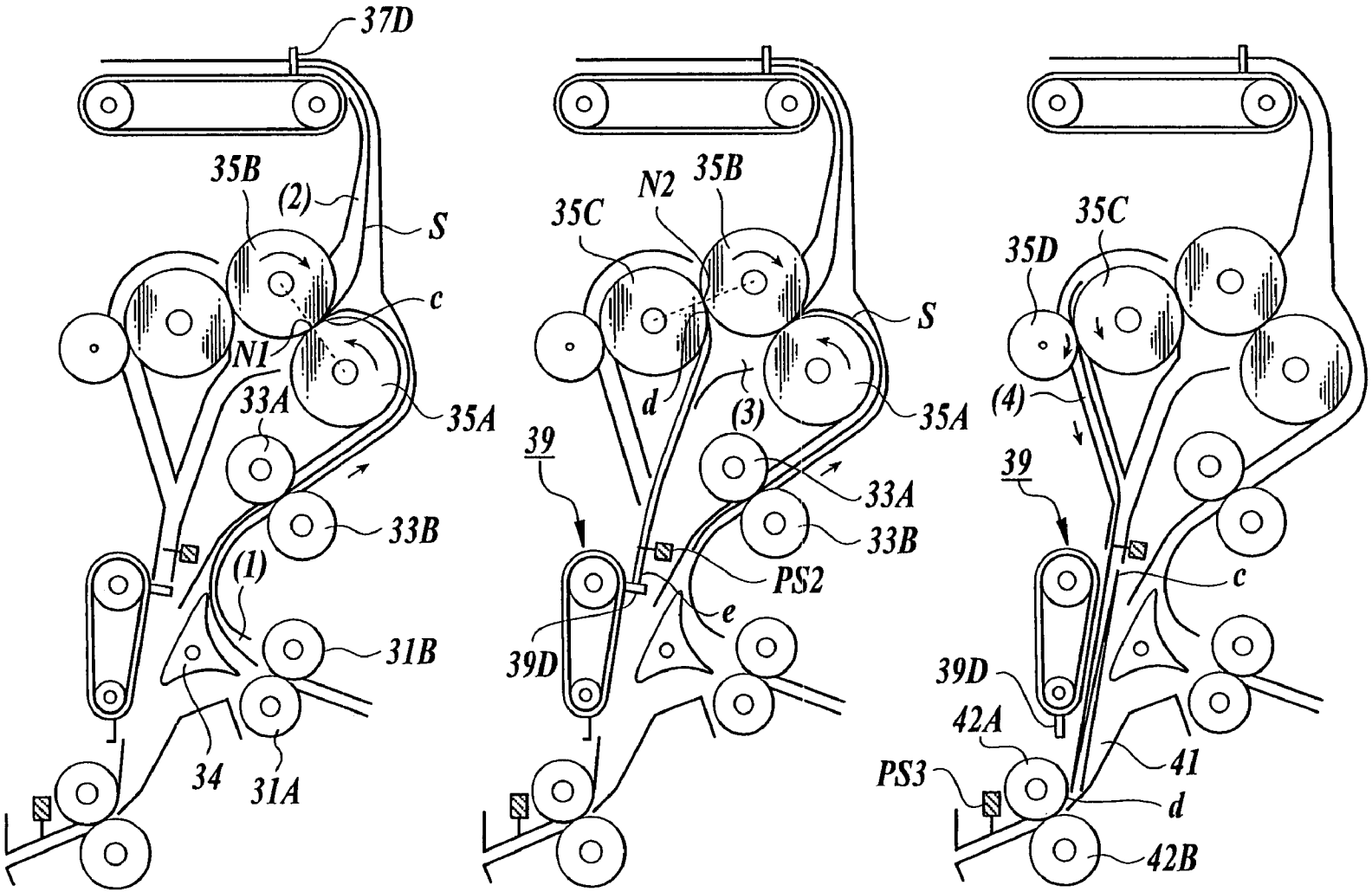
FIG. 4A is a cross sectional view showing a conveyance path of a sheet to be Z-folded.
FIG. 4B is a cross sectional view showing a conveyance path of the sheet to be Z-folded.
FIG. 4C is a cross sectional view showing a conveyance path of the sheet to be Z-folded.

FIGS. 4A to 4C are cross sectional views showing the conveyance path of the sheet S to be Z-folded.

FIG. 4A shows the process of forming the first fold c. The front end portion of the sheet S which goes into the second conveyance path (2) by passing through the first conveyance path (1) stops by running into the stopper portion 37D of the first stop section 37. A bowing is generated in the intermediate portion of the sheet S by conveying continuously the sheet S by the intermediate conveyance rollers 33A and 33B, and the sheet S is wound in the nipping position N1 of the first folding rollers 35A and 35B, so that the first fold c is folded (c.f. FIG. 2B).

FIG. 4B shows the process of forming the second fold d. The sheet S folded by the first folding rollers 35A and 35B is conveyed so as to proceed along the third conveyance path (3) by making the first fold c the front end, and stops by running into the stopper portion 39D of the second stop section 39. A bowing is generated in the intermediate portion of the sheet S so as to be crooked by conveying continuously the sheet S by the first folding rollers 35A and 35B, and the sheet S is wound in the nipping position N2 of the first folding roller 35B and the second folding roller 35C, so that the second fold d is folded and Z-folding is performed (c.f. FIG. 2B).

FIG. 4C shows the process of ejecting the sheet S after the Z-folding is completed. After the Z-folding is completed, the second stop section 39 is driven, and the stopper portion 39D moves out of the downstream side conveyance path of the third conveyance path (3). The Z-folded sheet S passes through the sheet ejection path 41, and is ejected out of the finisher B by being nipped by the sheet ejection rollers 42A and 42B.

[Second Finisher]

Figure 5:
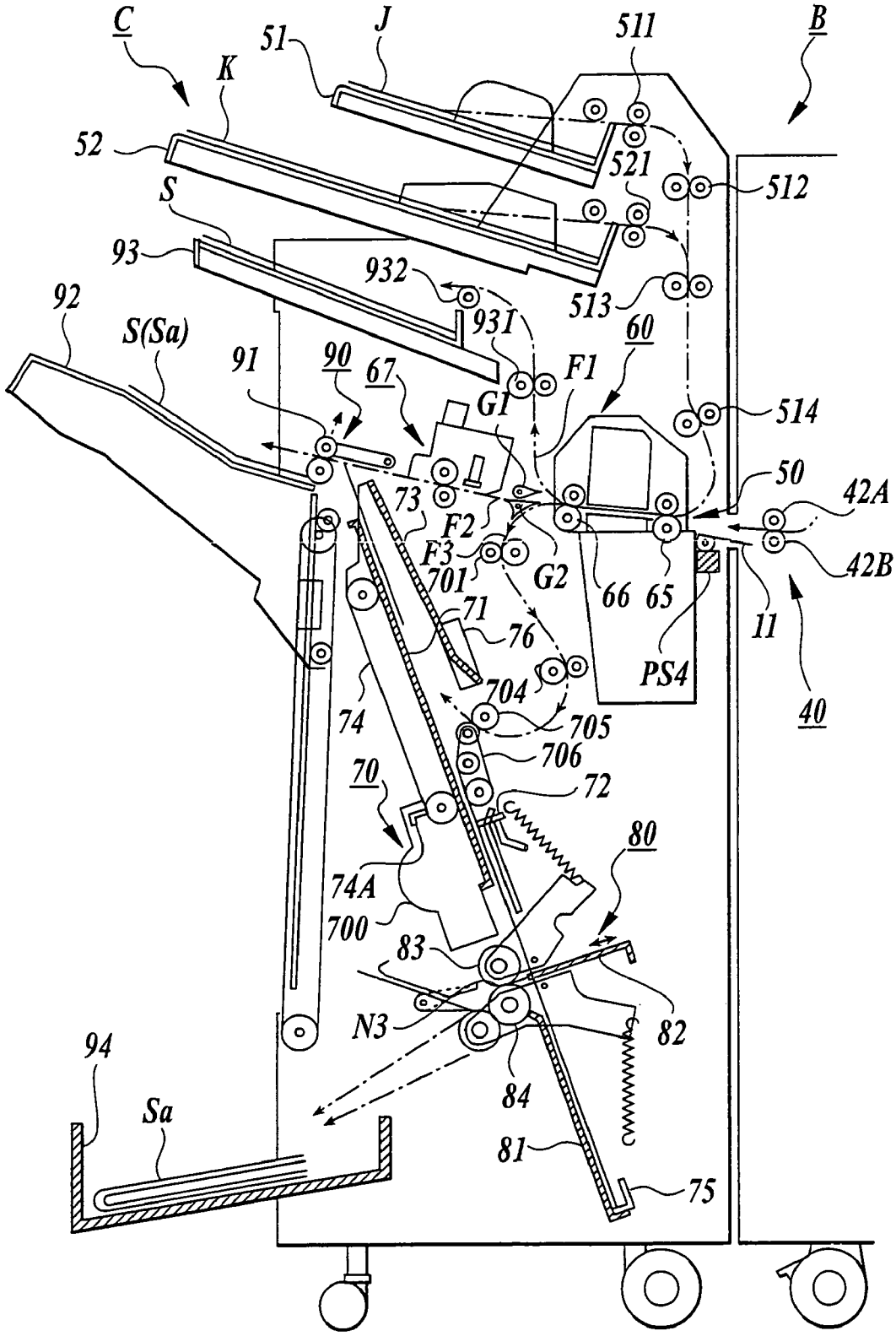
FIG. 5 is a cross sectional view showing a conveyance path of a sheet in the second finisher.

FIG. 5 is a cross sectional view showing the conveyance path of the sheet S in the second finisher C.

In the second finisher C, the first sheet feeding section 51, the second sheet feeding section 52, and the upper sheet ejection table 93 are arranged in the upper stage in the figure, the second punching section 60, the shifting section 67, and the sheet ejection section 90 are arranged serially to be in one approximately horizontal plane in the middle stage, and the accumulation section 70 and the second folding section 80 are arranged serially to be in one inclined plane in the lower stage.

Further, in the left side face of the second finisher C in the figure, the up-and-down sheet ejection table 92 for stacking a shifted sheet S and a stack of end-stapled sheets Sa thereon, and the lower sheet ejection table 94 for stacking a three-folded sheet S and a stack of midway folded sheets Sa are arranged.

(1) Entrance Section

In the entrance section 50 of the second finisher C, a simply passed sheet S or a sheet S to which either of punching holes or folding is performed is fed. Further, in the entrance section 50, inserting sheets (inter sheets) J for dividing off between stacks of sheets, which are fed from the first sheet feeding section 51 provided on the upper portion of the second finisher C, and cover sheets K fed from the second sheet feeding section 52 are fed. In the vicinity of the entrance section 50, the entrance sensor PS4 for detecting the passage of the front end of the sheet S is arranged.

(2) Sheet Feeding Sections

The inserting sheets J contained in a sheet feeding tray in the first sheet feeding section 51 are separated and fed by the sheet feeding rollers 511, nipped by the conveyance rollers 512, 513 and 514, and fed into the entrance section 50. Further, the cover sheet K contained in a sheet feeding tray in the second sheet feeding section 52 are separated and fed by the sheet feeding rollers 521, nipped by the conveyance rollers 513 and 514, and fed into the entrance section 50.

(3) Second Punching Section

The second punching section 60 is arranged in the downstream side in the sheet conveyance direction in the entrance section 50. In the upstream side in the sheet conveyance direction of punching positions according to the second punching section 60, register rollers 65 are arranged, and in the downstream side in the sheet conveyance direction of the punching positions, conveyance rollers 66 are arranged, respectively.

(4) Sheet Dividing Section

In the downstream side in the sheet conveyance direction of the second punching section 60, a sheet dividing section comprising switching gates G1 and G2 is provided. The switching gates G1 and G2 divide selectively into one of three sheet conveyance paths, that is, a first conveyance path F1 reaching the upper sheet ejection table 93, a second conveyance path F2 reaching the sheet ejection section 90 in the middle stage, and a third conveyance path F3 reaching the accumulation section 70 in the lower stage, by driving the non-shown solenoid.

(5) Simple Ejection of Sheet

When it is set to this sheet conveyance mode, the switching gate G1 opens only the first conveyance path F1, and closes the second conveyance path F2 and the third conveyance path F3.

The sheet S passing along the first conveyance path F1 is nipped by the conveyance rollers 931 to go upward, and ejected by the ejection rollers 932. Then, the sheet S is placed and sequentially stacked on the upper sheet ejection table 93. Here, in case of punching holes in the sheet S, the second punching section 60 is operated. On the upper sheet ejection table 93, up to approximately 200 of sheets S can be stacked.

(6) Shifting Processing

When it is set to this conveyance mode, the switching gate G1 moves out upwardly. Then, the switching gate G2 closes the third conveyance path F3, and opens the second conveyance path F2, so that the sheet S can pass through the second conveyance path F2. The sheet S passes between the switching gates G1 and G2.

The sheet S ejected from the first finisher B, an inserting sheet J fed from the first sheet feeding section 51, or a cover sheet K fed from the second sheet feeding section 52 passes through the intermediate sheet passage path between the switching gates G1 and G2, and shifted to a direction perpendicular to the sheet conveyance direction by the shifting section 67.

The shifting section 67 performs shifting processing for changing the sheet ejection position of the sheet S in the conveyance width direction every predetermined number of sheets. The shifted sheet S is ejected to and sequentially placed on the up-and-down sheet ejection table 92 outside of the finisher C by ejection paired rollers (paired rollers) 91 in the sheet ejection section 90. In case of ejecting many sheets S, the up-and-down sheet ejection table 92 will be made to go down sequentially, and can contain up to approximately 3000 (A4 size and B5 size) of sheets S.

(7) End-Stapling

Figure 6A:
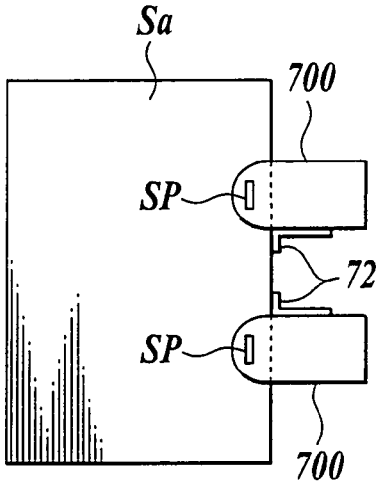
FIG. 6A is a plan view showing a state that staples are stapled in two portions in the vicinity of side edge of a stack of sheets.
Figure 6B:
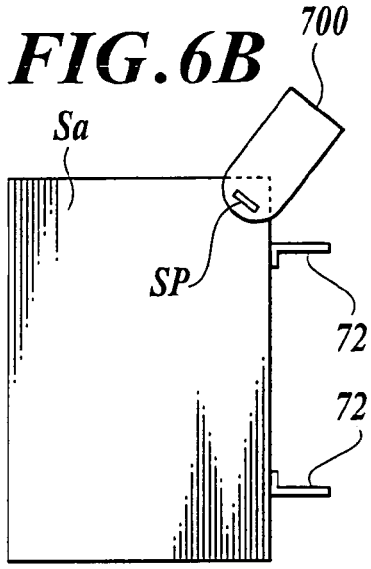
FIG. 6B is a plan view showing a state that a staple is stapled in a corner portion of a stack of sheets.

FIG. 6A is a plane view showing a state that two staples SP are stapled in two portions in the vicinity of the side end of a stack of sheets Sa by two stapling members 700. FIG. 6B is a plane view showing a state that a staple SP is stapled in the corner portion of a stack of sheets Sa by a stapling member 700.

When stapling or folding is set in the operation section 9 of the image forming apparatus A, the sheet S on which the image is formed in the image forming apparatus A and which is fed into the entrance section 50 of the second finisher C via the first finisher B passes through the second punching section 60, and is fed into the third conveyance path F3 downward of the switching gate G2. Then, the sheet S is nipped and conveyed by the conveyance rollers 701 and 704, and the front end portion of the sheet S abuts in the vicinity of the nipping position of entrance conveyance paired rollers (register rollers) 705 to stop, so that front end adjustment of the sheet S is performed (c.f. FIG. 5).

After the rear end portion in the proceeding direction of the sheet S is ejected on a sheet placing table (sheet placing member) 71 from the nipping position of the entrance conveyance paired rollers 705, the sheet S goes down by its own weight, and slides down along the inclined surface of the sheet placing table (intermediate stacker) 71. Then, the rear end portion of the sheet S (that is, the end portion of the sheet S finally ejected from the entrance conveyance paired rollers 705) is slid and conveyed by a winding belt 706, and the rear end portion of the sheet S abuts against the sheet stopper surface of a position regulation member for end-stapling (hereinafter, it is referred to as "end-stapling stopper") 72 provided in the vicinity of the stapling member 700 to stop. Then, the longitudinal direction (that is, the sheet conveyance direction) of the sheet S is adjusted.

The numeral 73 denotes a pair of width-adjusting members provided movably on the both sides of the sheet placing table 71, and it adjusts the width direction perpendicular to the longitudinal direction of the sheet S. When a predetermined number of sheets S is stacked and adjusted on the sheet placing table 71, the sheets S are stapled by the stapling members 700.

The rear end portion of stapled stack of sheets Sa in the ejection direction is supported by an ejection claw (conveyance member) 74A provided on a turning ejection belt 74, and the stack of sheets Sa slides along the placing surface of the sheet placing table 71 so as to be pushed obliquely upward. The stack of sheets Sa nipped by the ejection paired rollers 91 is ejected and stacked on the up-and-down sheet ejection table 92.

(8) Midway Stapling

Figure 6C:
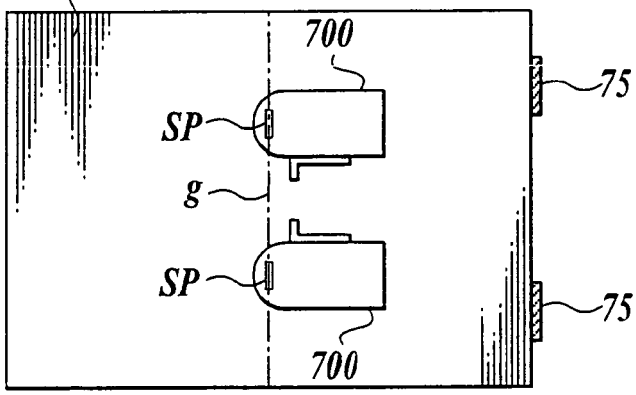
FIG. 6C is a plan view showing a state that two staples are stapled in central portion of a stack of sheets.

FIG. 6C is a plane view showing a state that two staples SP are stapled in two central portions of a stack of sheets Sa by two stapling members 700.

When it is set to midway stapling and midway folding mode, the end-stapling stopper 72 in the vicinity of stapling processing position (stapling position of the staplers) of the stapling members 700 moves out of the conveyance path. At approximately the same time, the position regulation member used both as midway stapling and midway folding 75 which is more downstream than the stopper 72 moves in the longitudinal direction of the sheet passage path, and stops at a predetermined position corresponding to the size of the sheet S (length in the conveyance direction) (c.f. FIG. 5).

After the last sheet S positioned and placed on the sheet placing table 71, the stack of sheets Sa comprising a cover sheet K and the whole pages of the sheets S is midway stapled by the stapling members 700. The staplers SP are stapled in the central portion of the stack of sheets Sa in the conveyance direction by the midway stapling.

(9) Midway Folding

Figure 6D:
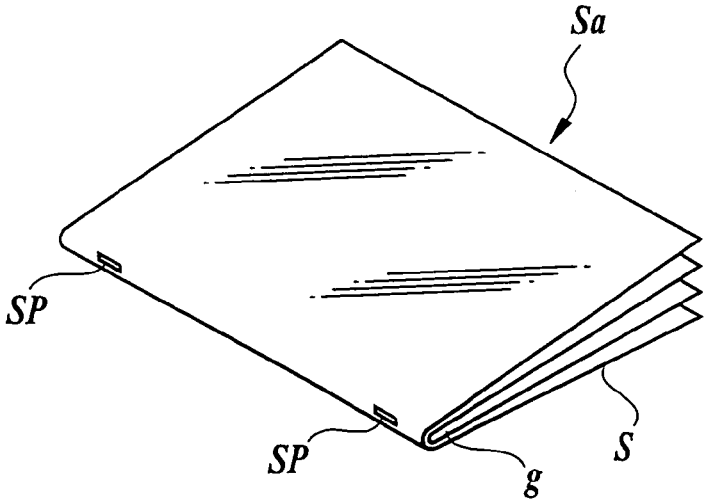
FIG. 6D is a perspective view showing a stack of sheets to which midway folding is performed after midway stapling.

FIG. 6D is a perspective view showing a stack of sheets Sa to which midway folding is performed after midway stapling.

According to a midway folding start signal, a folding plate 82 connected to a driving source projects in more left direction in the figure than the sheet placing surface of a guide plate 81. The front end portion of the folding plate 82 proceeded and projected in the left direction in the figure pushes the central portion of the stack of sheets Sa, and pushes the nipping position N3 of the first folding rollers 83 and 84 through the stack of sheets Sa to open and separate them (c.f. FIG. 5).

After the front end portion of the folding plate 82 passes through the nipping position N3 of the first folding rollers 83 and 84, the folding plate 82 goes back, and the central portion of the stack of sheets Sa is nipped and pressed by the first folding rollers 83 and 84, so that a fold g is formed. The fold g approximately consistent with the stapling position of the staplers SP to the stack of sheets Sa according to midway stapling.

The nipped and pressed stack of sheets Sa in which the fold g is formed is conveyed to be ejected by the first folding rollers 83 and 84, which are driven to rotate, and is placed on the lower sheet ejection table 94 outside of the finisher C (c.f. FIG. 5).

(10) Z-Folding

Figure 7:
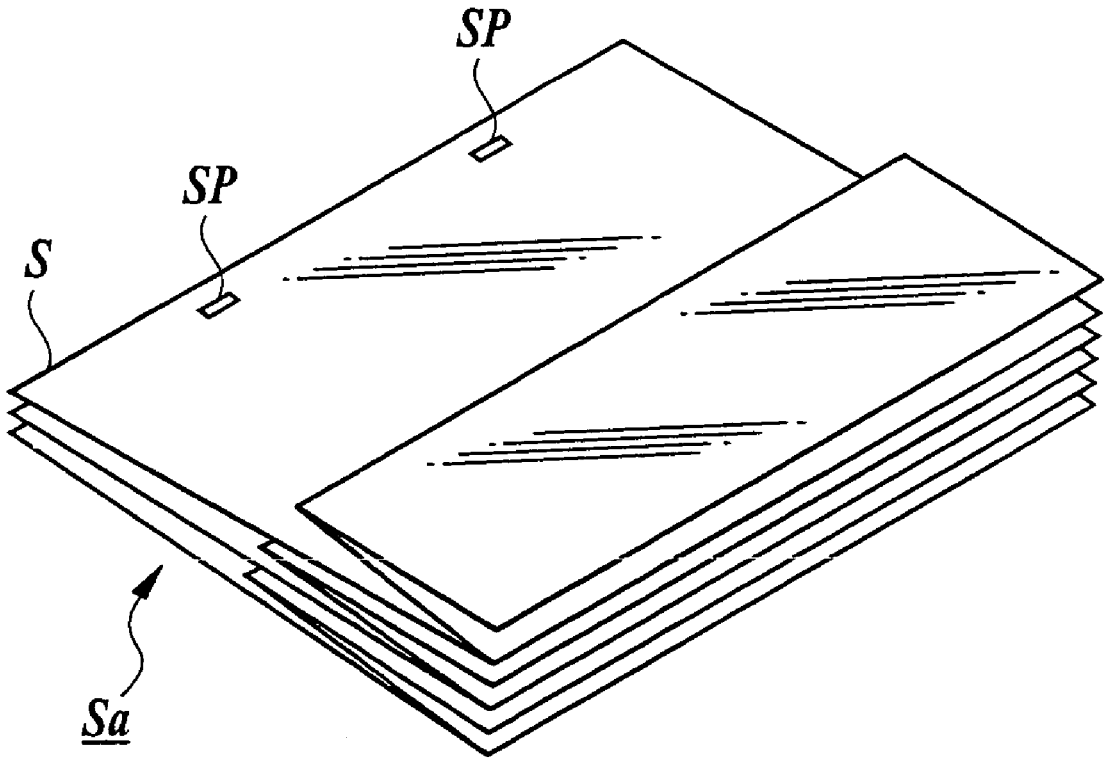
FIG. 7 is a perspective view showing a state that staples are stapled in two portions in the vicinity of side edge of a stack of Z-folded sheets.

FIG. 7 is a perspective view showing a state that two staplers SP are stapled in two portions in the vicinity of the side edge of a stack of sheets Sa by two stapling members 700 after Z-folding is performed.

[Air-Blowing Member]

Figure 8:
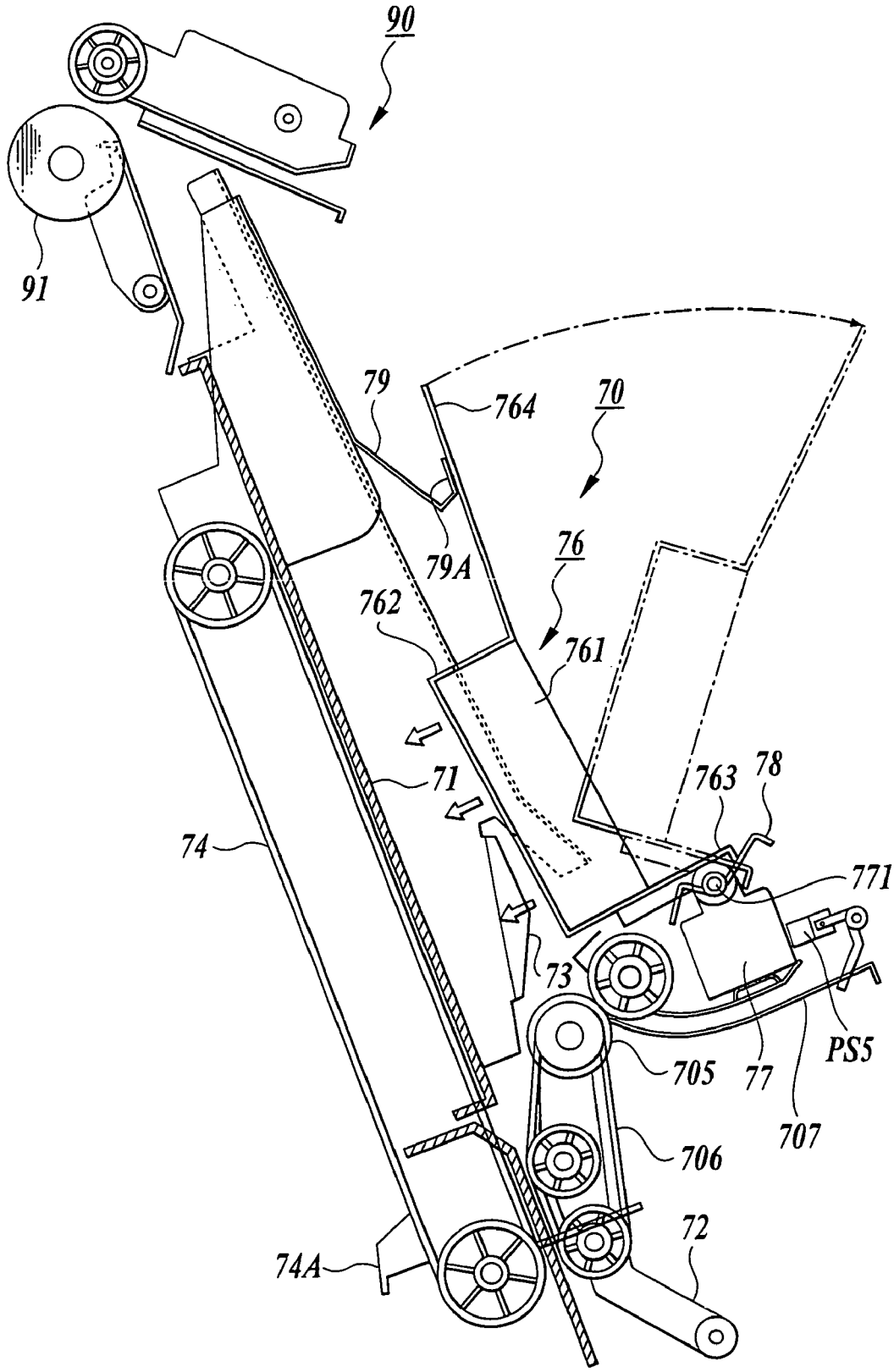
FIG. 8 is a cross sectional view showing an accumulation section and sheet ejection section.
Figure 9:
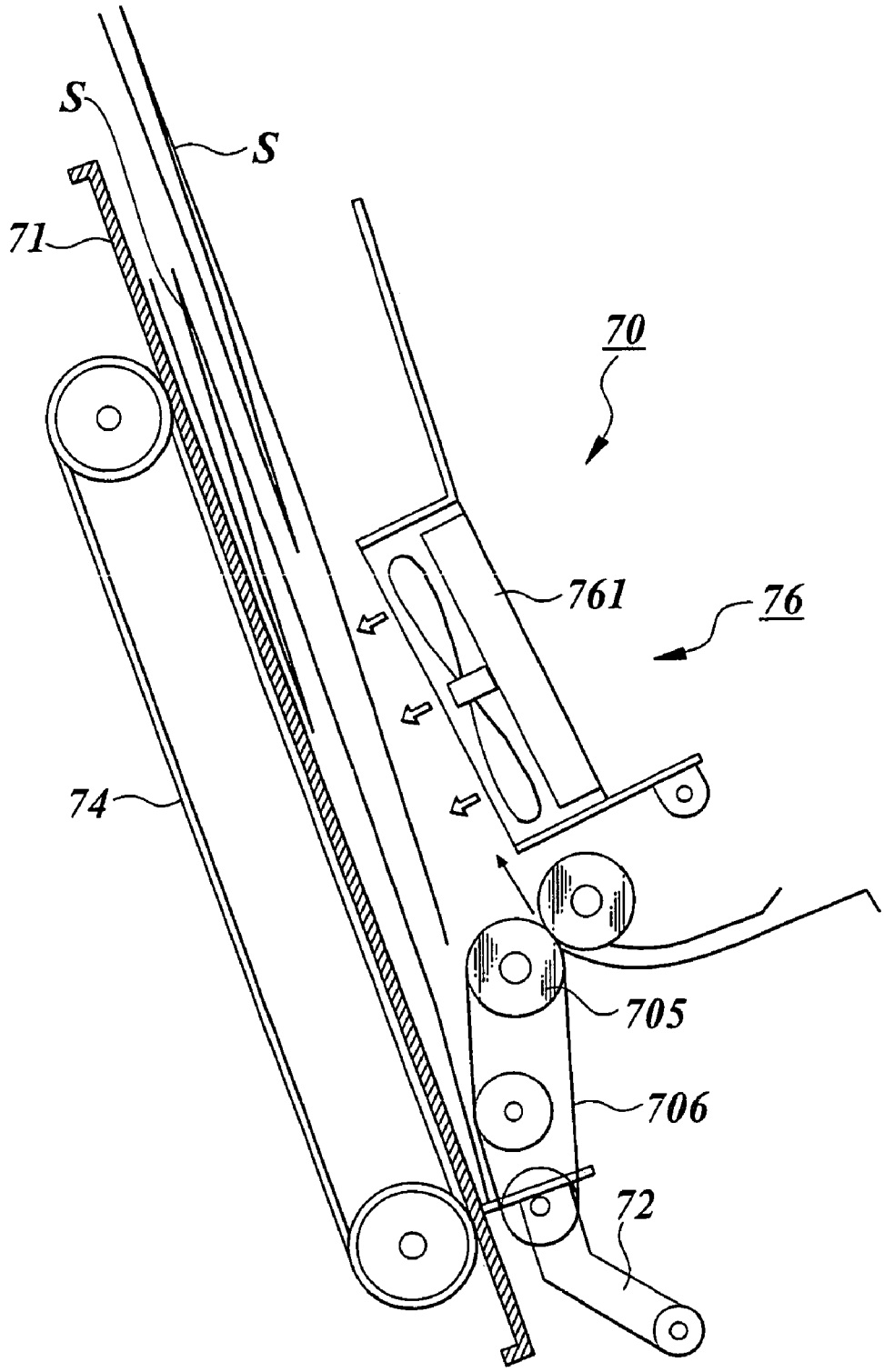
FIG. 9 is a cross sectional view of the accumulation section showing a state containing Z-folded sheets.

FIG. 8 is a cross sectional view showing the accumulation section 70 and the sheet ejection section 90. FIG. 9 is a cross sectional view of the accumulation section 70 showing a state that the sheet S punched or folded in the first finisher B is contained. Hereinafter, for convenience, a Z-folded sheet S will be explained as an example.

Above the sheet placing table 71, an air-blowing member 76 is arranged. The air-blowing member 76 comprises a fan motor 761 and a holding frame body 762 for holding the fan motor 761. The fan motor 761 is arranged in the vicinity of the middle portion of the length of the Z-folded sheet S in the conveyance direction that is placed on the sheet placing table 71, and in the vicinity of the middle portion in the width direction perpendicular to the conveyance direction of the Z-folded sheet S. For example, in case of Z-folding the sheet S of A3 size, the length of the sheet S in the conveyance direction is 210 mm, and the center position of the fan motor 761 is set to approximately 105 mm obliquely upward of the sheet conveyance path from the stop position of the end-stapling stopper 72.

The Z-folded sheet S whose overlapped portion has a swollen shape is nipped and conveyed by the entrance conveyance paired rollers 705, and released in the space above the sheet placing table 71. Then, the sheet S slides down along the inclined surface of the sheet placing table 71, and abuts against the end-stapling stopper 72 to stop.

The overlapped portion of the Z-folded sheet S in the upper portion in the figure that moves along the inclined surface of the sheet placing table 71 presses against the downward half-folded portion, and the sheet S becomes watered-down to be in a buckling state. Thereby, bad conveyance may be caused. Further, when a plurality of Z-folded sheets S are stacked, the swell of the sheets S increases, and the inclined sheets are curved, bent or the like by bowing. Therefore, there occurs a problem that a certain adjustment cannot be performed. The cause of the bowing of the sheets is more remarkable as the inclination of the sheet placing table 71 is made steep.

Further, if there is swell in the sheet overlapped portion in a stack of stapled sheets Sa stacked on the sheet placing table 71 when the Z-folded sheets S are conveyed along the sheet placing table 71 after being stapled and nipped by the ejection paired rollers 91 to be ejected, the front end portion of the stack of sheets Sa in the ejection direction comes apart. Thereby, the stack of sheets Sa is difficult to be nipped by the rotating ejection paired rollers 91, so that bad ejection of sheets is caused.

Then, the air-blowing member 76 in the embodiment operates the fan motor 761 when the Z-folded sheet S is placed on the inclined surface of the sheet placing table 71. The back surface of the Z-folded sheet S is pressed against on the sheet placing table 71 by airflow (white filled arrow in the figure). Thereby, the Z-folded sheet S is made flat, so that the Z-folded sheet S can slide down smoothly along the sheet placing table 71 and can certainly reach the end-stapling stopper 72. Here, since the inclined surface of the sheet placing table 71 for placing the sheet S is a metal surface, in case that air blowing according to the air-blowing member 76 is started when a first sheet S (that is, the sheet to become in contact with the metal surface) is placed on the inclined surface of the sheet placing table 71, the sheet S may be adhered to the metal surface of the sheet placing table 71. Therefore, a problem such that the sheet S does not slide down smoothly along the sheet placing table 71 may be caused. Then, in the embodiment, the air-blowing member 76 is not operated when the first sheet S is placed on the sheet placing table 71, and then after the first sheet S is ejected on the sheet placing table 71, air-blowing is started. Here, the force of air-blowing is set to an extent such that the Z-folded or non-Z-folded sheet S can slide down along the sheet placing table 71 by its own weight.

The end-folded stack of sheets Sa is supported by the ejection claw 74A of the turning ejection belt 74. When the stack of sheet Sa is conveyed to the sheet ejection section 90, the back surface of the Z-folded sheets S is pressed against the sheet placing table 71 by airflow (white filled arrow in the figure) according to operation of the fan motor 761. Thereby, the Z-folded sheets S are made flat, so that the sheets S can be conveyed smoothly along the sheet placing table 71 and can reach certainly the ejection paired rollers 91.

(1) Jam Processing

One end portion 763 of the holding frame body 762 of the air-blowing member 76 is supported oscillatably to a supporting shaft 771 fixed to a supporting member 77. The supporting member 77 is fixed to a guide plate 707 arranged in the upstream side in the sheet conveyance direction of the entrance conveyance paired rollers 705. The holding frame body 762 is urged by a spring 78 wound around the supporting shaft 771, and oscillated toward the sheet conveyance path side in the above of the sheet placing table 71.

The other end portion 764 of the holding frame body 762, which has an extended lingual shape, contacts and leaves a front end portion 79A of a fixing member 79 fixed to the sheet placing table 71. The holding frame body 762 urged by the spring 78 is positioned by abutting against the front end portion 79A of the fixing member 79.

When the sheet S conveyed badly in the sheet conveyance path above the sheet placing table 71 is taken out, the end portion 764 of the holding frame body 762 is grasped, and the air-blowing member 76 is oscillated toward the direction shown by one dotted line in FIG. 8 to open the sheet conveyance path is opened.

(2) Controlling the Air-Blowing Member

Figure 10:
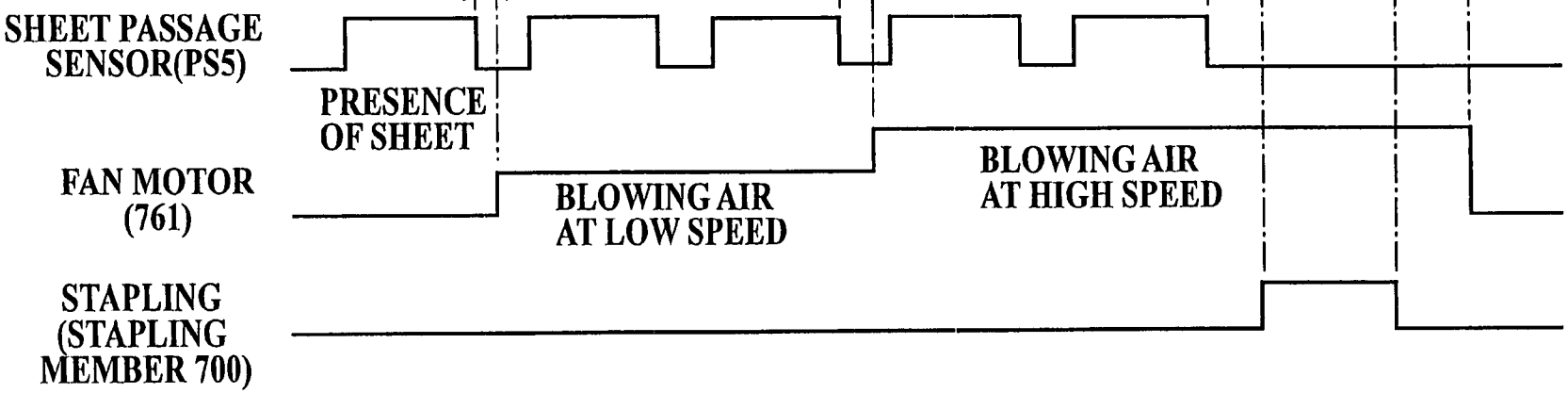
FIG. 10 is a timing diagram showing air-blowing control according to a fan motor of an air-blowing member.

FIG. 10 is a timing diagram showing air-blowing control according to the fan motor 761 of the air-blowing member 76.

A control section varies the amount of air blowing by the air-blowing member 76 in accordance with the number of Z-folded sheets S placed sequentially on the sheet placing table 71. For example, it is capable of switching to two-speed air blowing such that blowing air at low speed of 0.9 to 1.25 m/min and blowing air at high speed of 1.25 to 3 m/min.

That is, the control section starts blowing air at low speed by driving the fan motor 761 after a predetermined time t1 has passed after the sheet passage sensor PS5 detects the passage of the rear end portion of the first sheet S.

Then, the control section switches to blowing air at high speed after a predetermined time t2 has passed after the sheet passage sensor PS5 detects the passage of the rear end portion of a third sheet S.

Then, the control section make the staples SP staple the adjusted stack of sheets Sa by driving the stapling member 700 after a predetermined time t3 has passed after the sheet passage sensor PS5 detects the passage of the last sheet S, for example, a fifth sheet S.

After stapling according to the stapling member 700 is completed, and after a predetermined time t4 has passed, the control section makes the fan motor 761 stop blowing air.

During the passage of the predetermined time t4, the stapled stack of Z-folded sheets Sa is ejected from the sheet placing table 71.

Thus, the Z-folded sheets S and the like are conveyed, adjusted, and stapled in the accumulation section 70, ejected from the sheet ejection section 90, and placed on the up-and-down sheet ejection table 92.

[Driving System of Sheet Ejection Section]

Figure 11:
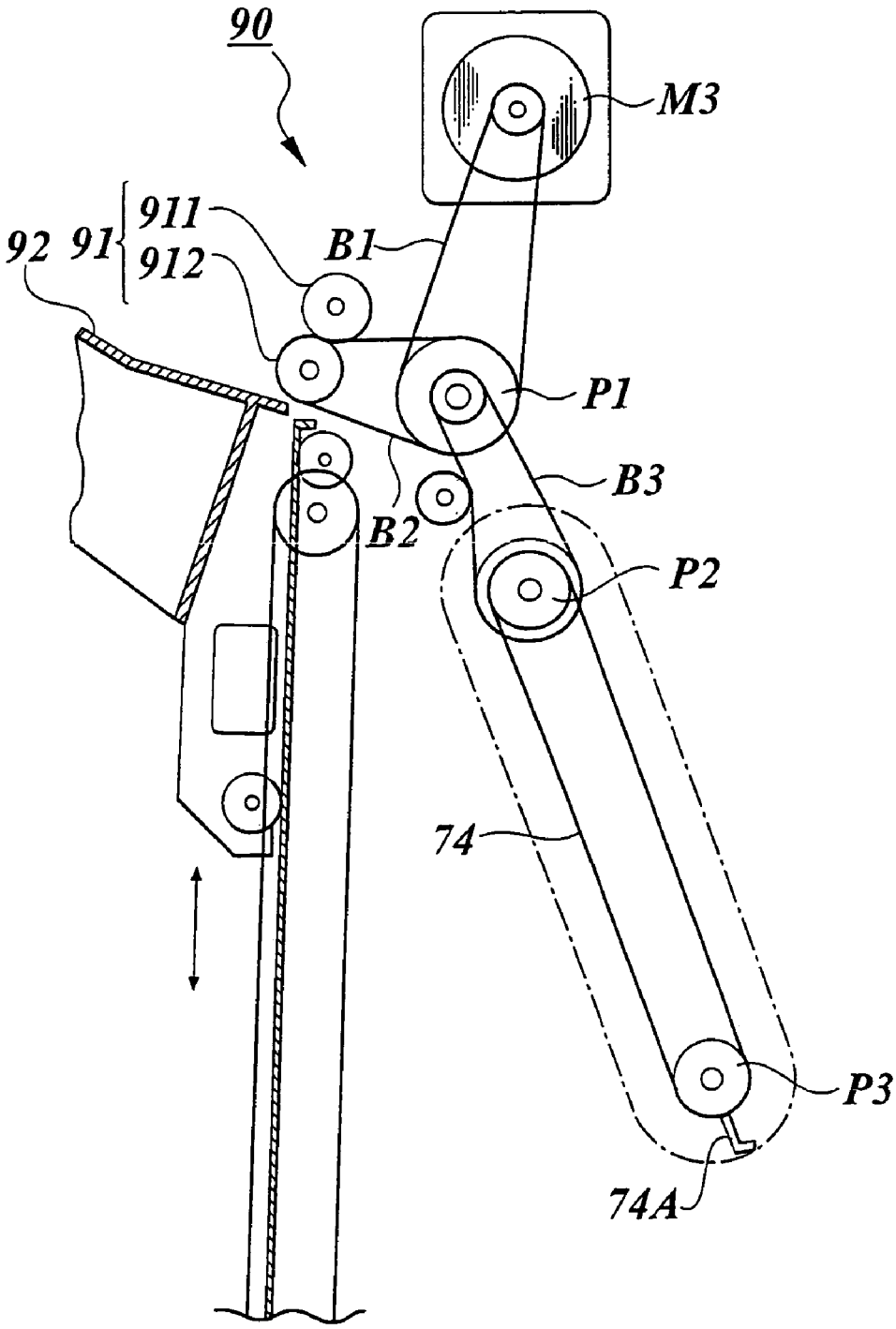
FIG. 11 is a construction view showing a driving system of a sheet ejection section of the second finisher.

FIG. 11 is a construction view showing a driving system of the sheet ejection section 90 of the second finisher C.

A stepping motor (driving source; hereinafter, it is referred to as "motor") M3 rotates a driving roller (first roller; hereinafter, it is referred to as "lower roller") 912 of the ejection paired rollers 91 via timing belts B1 and B2 and an intermediate pulley P1. The motor M3 further rotates a driving pulley P2 via the intermediate pulley P1 and a timing belt B3, and turns the ejection belt 74 tightly stretched between the driving pulley P2 and a driven pulley P3.

Oscillation Section of Sheet Ejection Section

Figure 12:
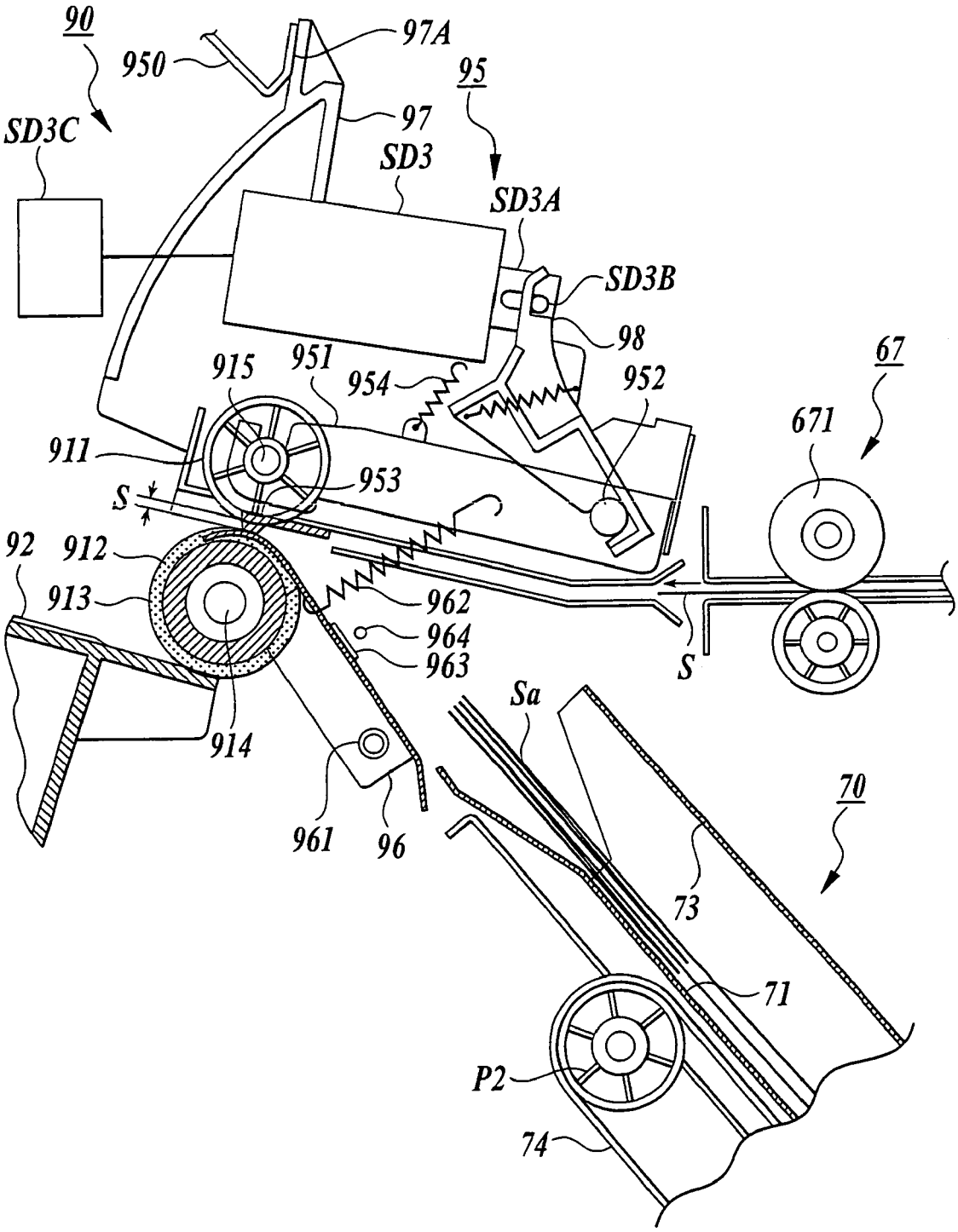
FIG. 12 is a cross sectional view showing the sheet ejection section.

FIG. 12 is a cross sectional view showing the sheet ejection section 90.

The ejection paired rollers 91 of the sheet ejection section 90 comprises the lower roller 912 which is rotated by being connected to the motor M3 shown in FIG. 11, a driven roller (second roller; hereinafter, it is referred to as "upper roller") 911 which press-contacts with the lower roller 912 and is rotated, and an elastic roller 913. The lower roller 912 is driven to rotate at a fixed position. The upper roller 911 is supported by an arm member 951 of the oscillation section 95, and is oscillatable around an oscillating shaft 952. In a state that the sheet ejection path is opened according to upward oscillation of the upper roller 911, a large size sheet is conveyed, adjusted, and stacked on the sheet placing table 71 from the entrance conveyance paired rollers 705 (c.f. FIG. 8).

The rotating shaft 914 of the lower roller 912 is supported to both sidewalls of the body of the second finisher C, and connected to the motor M3, which is the driving source. A plurality of lower rollers 912 having rubber layer on the peripheral surface thereof, and a plurality of elastic rollers 913 having soft elastic material (sponge) layer on the peripheral surface thereof are fixed to the rotating shaft 914.

One guide plate 96 is supported in the middle in the shaft direction of the lower rollers 912 and the elastic rollers 913 by being oscillatable around a supporting shaft 961. The guide plate 96 is pulled upward by a spring 962, and abuts against a stopper 964 via a buffer material 963. At the time of the abutment, the upper surface of the guide plate 96 projects more upwardly than the outer peripheral surface of the elastic rollers 913.

Further, a plurality of upper rollers 911 are fixed to the rotating shaft 915.

The arm member 951 of the oscillation section 95, which supports the upper rollers 911, is oscillatable around the oscillating shaft 952, and stops oscillating by abutting the upper portion 97A of an opening and closing body 97 against the stopper 950 fixed to the body of the second finisher C.

The arm member 951 for supporting rotatably both shaft ends of the rotating shaft 915 of the upper rollers 911, and a lever member 98 engaged with a pin SD3B implanted in a plunger SD3A of the solenoid (press-contact drive mechanism) SD3 are fixed integrally to be oscillatable around the oscillating shaft 952.

The solenoid SD3 driven by a driving member SD3C drives the press-contact and release of the upper rollers 911 in response to the lower rollers 912. A stopper 953 is provided in the region out of passage of sheets S in the bottom portion of the arm member 951. The front end portion of the stopper 953 is disposed so that each peripheral surface of the upper rollers 911 and the guide plate 96 may keep a space s. The sheet S nipped by the conveyance rollers 671 in the shifting section 67 can be passed smoothly between the upper rollers 911 and the lower rollers 912 that are separated by keeping the space s, without contacting the elastic rollers 913.

The arm member 951 is urged toward the direction for separating the upper rollers 911 and the lower rollers 912 by the spring 954. The plunger SD3A is pulled in by driving the solenoid SD3, so that the lever member 98 connected to the plunger SD3A is oscillated in the counterclockwise direction in the figure around the oscillating shaft 952. The arm member 951 fixed to the oscillating shaft 952 is oscillated in the counterclockwise direction in the figure. According to the oscillation of the arm member 951, the upper rollers 911 supported rotatably to the front end of the arm member 951 press the lower rollers 912 by a predetermined pressure against the urging force of the spring 954.

[Opening and Closing Drive of Sheet Ejection Section]

FIGS. 13 to 15B are construction views showing a process of opening and closing drive of the sheet ejection section 90 ejecting a stack of sheets Sa made by stapling after Z-folding. Here, in order to make these drawings easily viewable, the stack of sheets Sa such that Z-folded sheets are stapled is shown by one Z-folded sheet.

After the front end portion or the rear end portion of the Z-folded sheet S nipped and conveyed by the conveyance rollers 701 and 704 is detected by the sheet passage sensor PS5, the sheet S is nipped and sent out by the entrance conveyance paired rollers 705, and is released on the sheet placing table 71 arranged to be inclined. Then, it contacts with the sheet placing table 71 or the upper surface of the sheet S stacked on the sheet placing table 71, and is conveyed in the conveyance direction which is obliquely upward. After the rear end portion of the sheet S in the proceeding direction is ejected from the nipping position of the entrance conveyance paired rollers 705, the sheet S falls by its own weight and slides down along the inclined surface of the sheet placing table 71. Then, the front end portion in the falling direction of the sheet S is slid by the winding belt 706, and the sheet S abuts against the sheet stopper surface of the end-stapling stopper 72 to stop.

Hereafter, for convenience, mainly one of the upper rollers 911 and its corresponding lower roller 912 are used to explain the embodiment.

The sheet ejection section 90 arranged upward of the sheet placing table 71 comprises the lower roller 912 which is driven to be rotated, and the upper roller 911 which press-contacts with the lower roller 912 and is rotated. The upper roller unit 901 for holding the upper roller 911 is connected to a disk 904 rotated by the stepping motor M4 (hereinafter, it is referred to as "motor") via gear train and to a crank lever 903, and is oscillatable around the supporting shaft 902.

When a large size of sheet (for example, A3 size or the like) S is fed on the sheet placing table 71, a driving source, which is not shown, is driven, and the upper roller unit 901 is oscillated around the supporting shaft 902 through the disk 904 and the crank lever 903. Then, the upper roller 911 is moved upward from its nipping position with the lower roller 912, and the sheet ejection path is opened. Thereby, the front end portion of the large size of sheet S can be passed.

Figure 16:
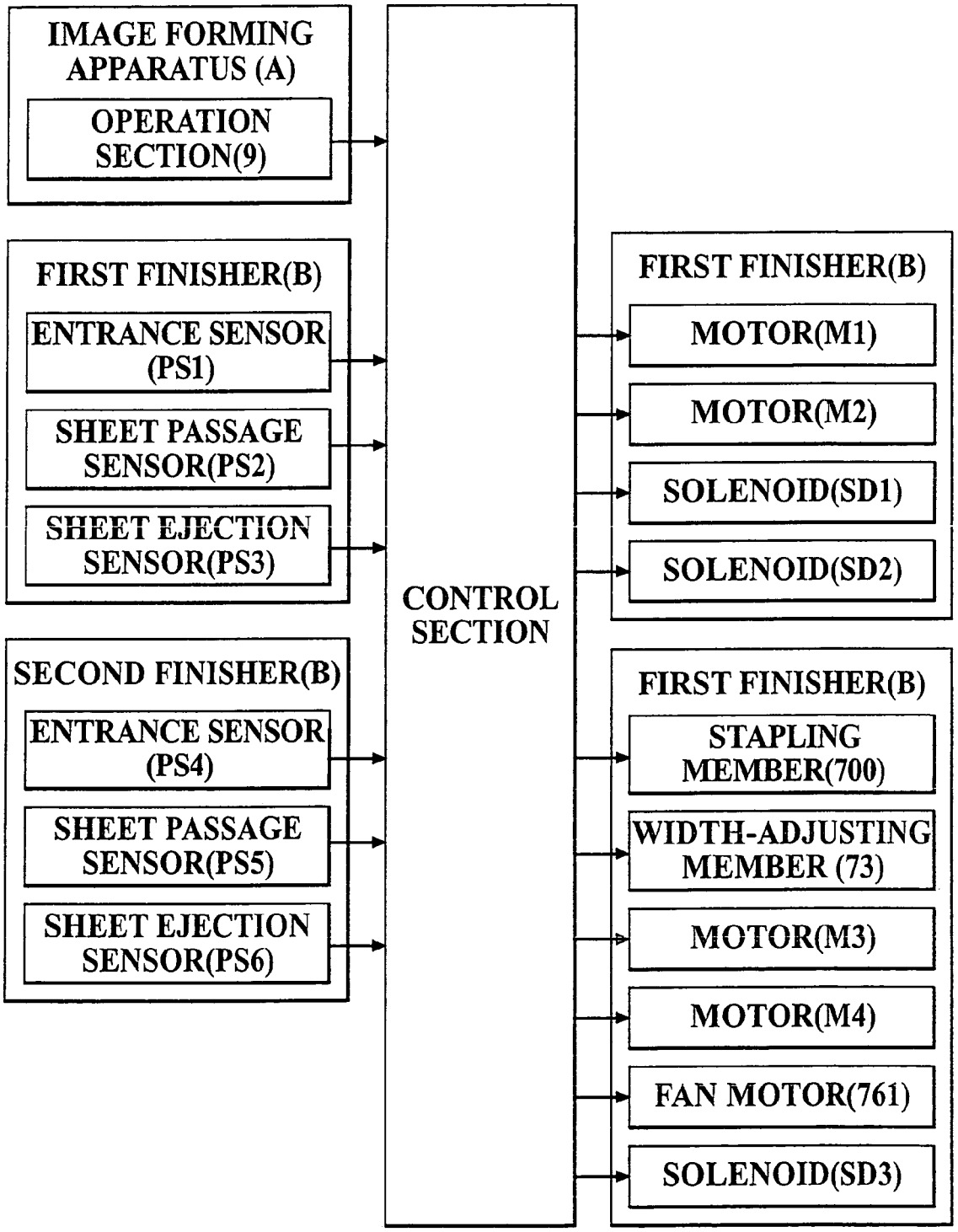
FIG. 16 is a block diagram showing control of the image forming system.
Figure 17:
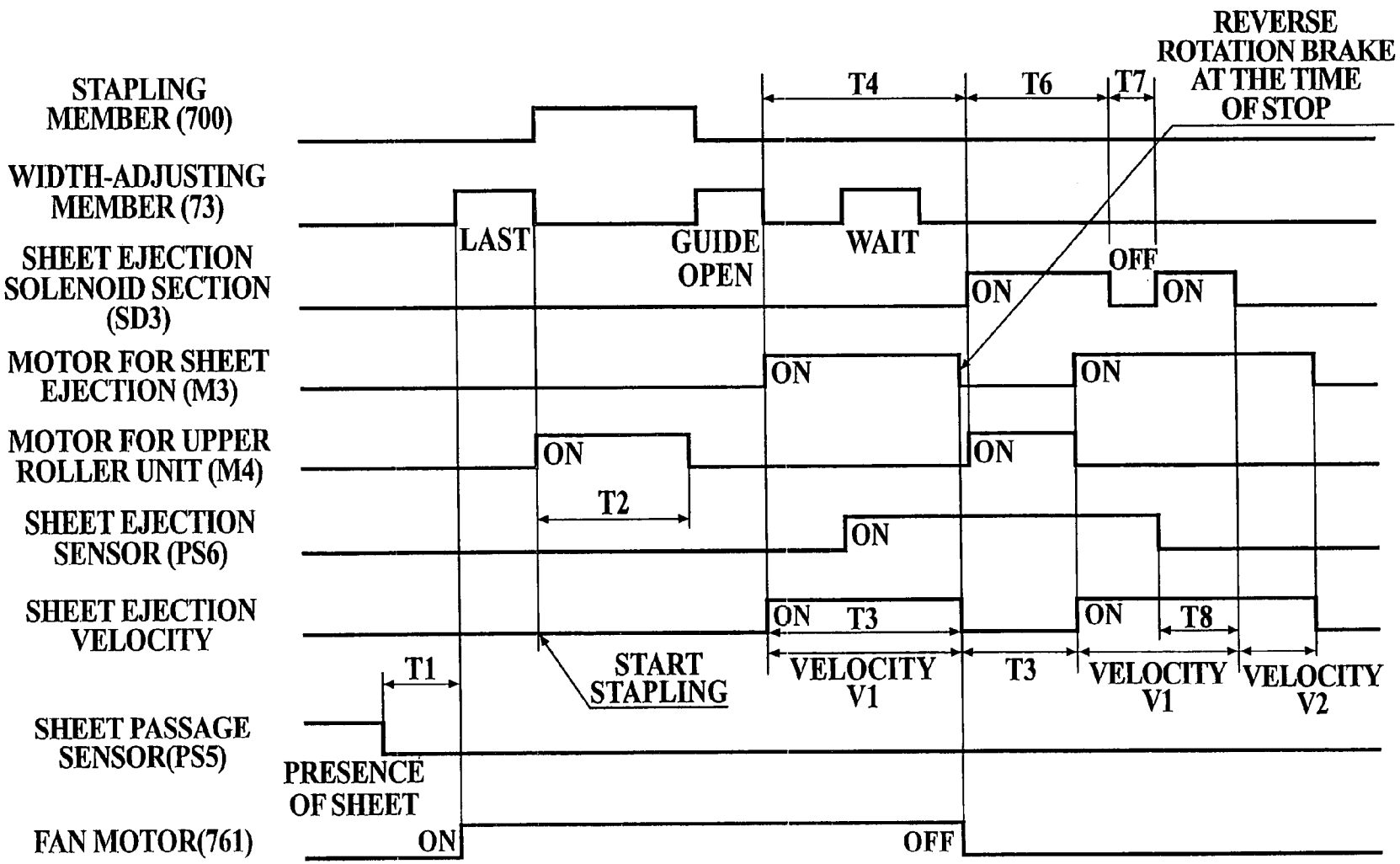
FIG. 17 is a timing diagram showing each process of stapling, adjustment, and ejection.
Figure 18:
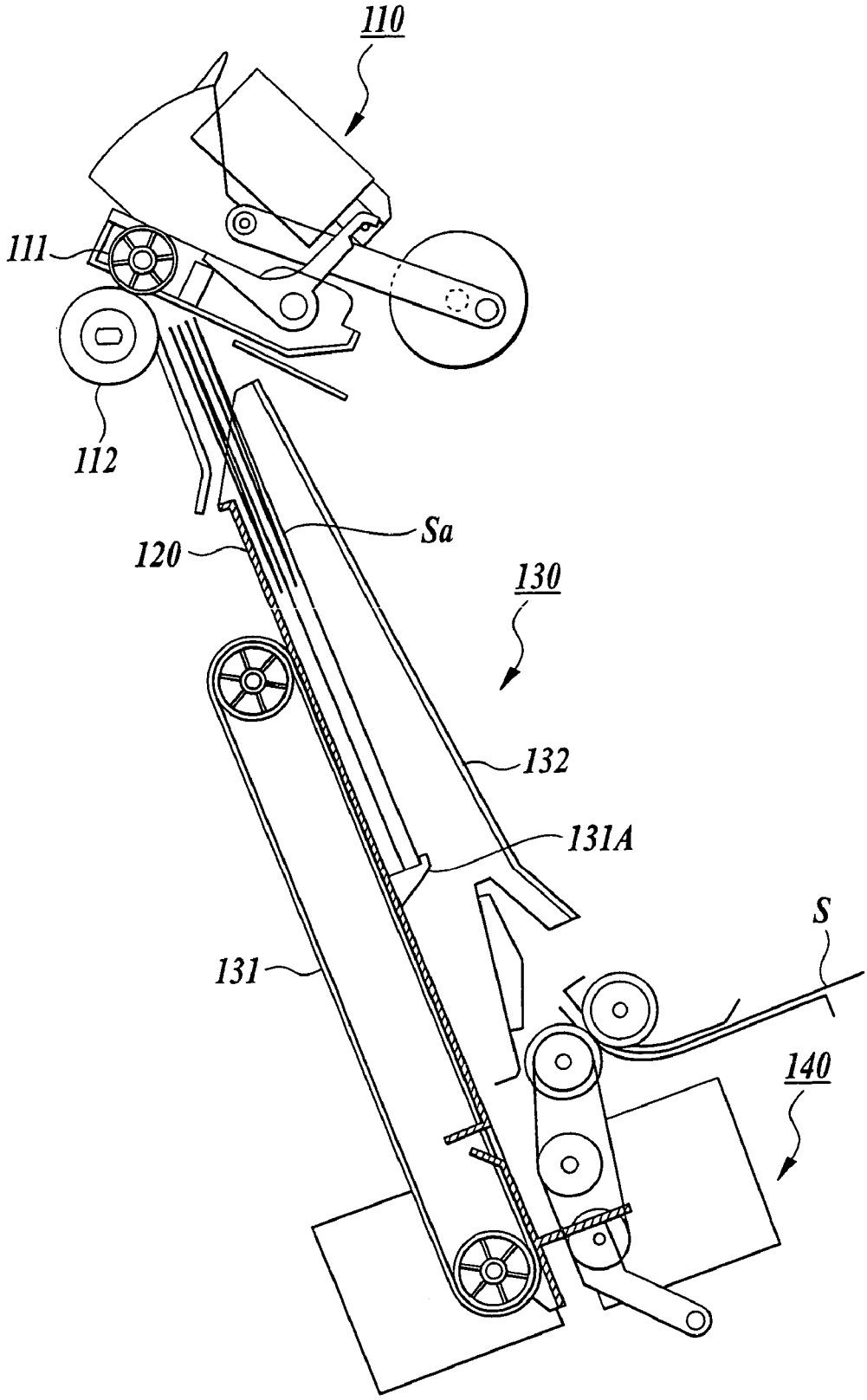
FIG. 18 is a cross sectional view showing an ejecting state of a stuck of Z-folded sheets in a sheet finisher in earlier technology.
Figure 19:
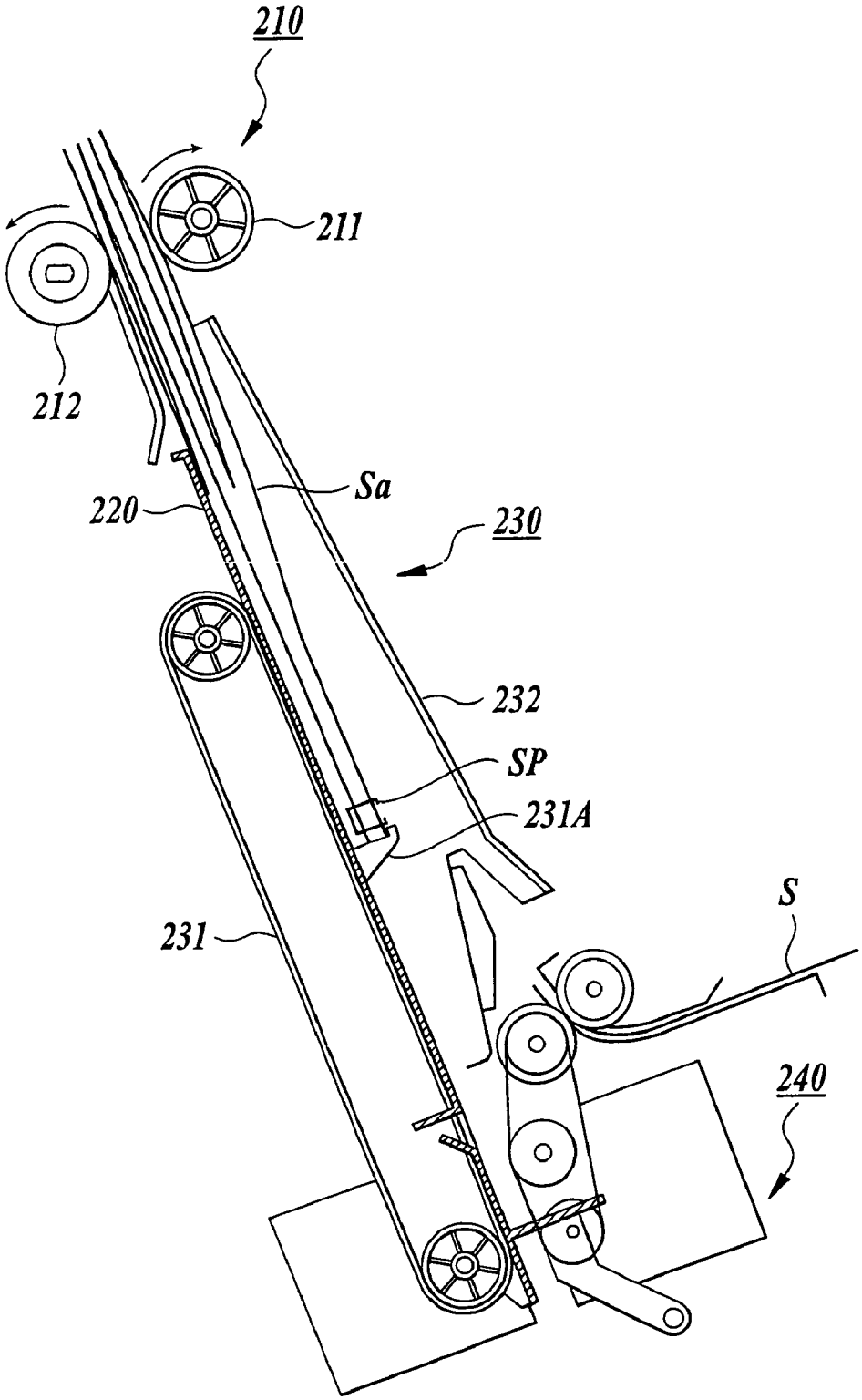
FIG. 19 is a cross sectional view showing an ejecting state of a stuck of Z-folded sheets in another sheet finisher in the earlier technology.

FIG. 16 is a block diagram showing the control of the second finisher C. FIG. 17 is a timing diagram showing each process of stapling, adjustment, and sheet ejection.

Hereafter, each process of stapling, adjustment, and sheet ejection will be explained.

(1) After a predetermined time T1 has passed after the rear end portion of the last sheet S is detected by the sheet passage sensor PS5, the fan motor 761 starts blowing air, and at the same time, the width-adjusting members 73 start adjusting width.

Figure 13:
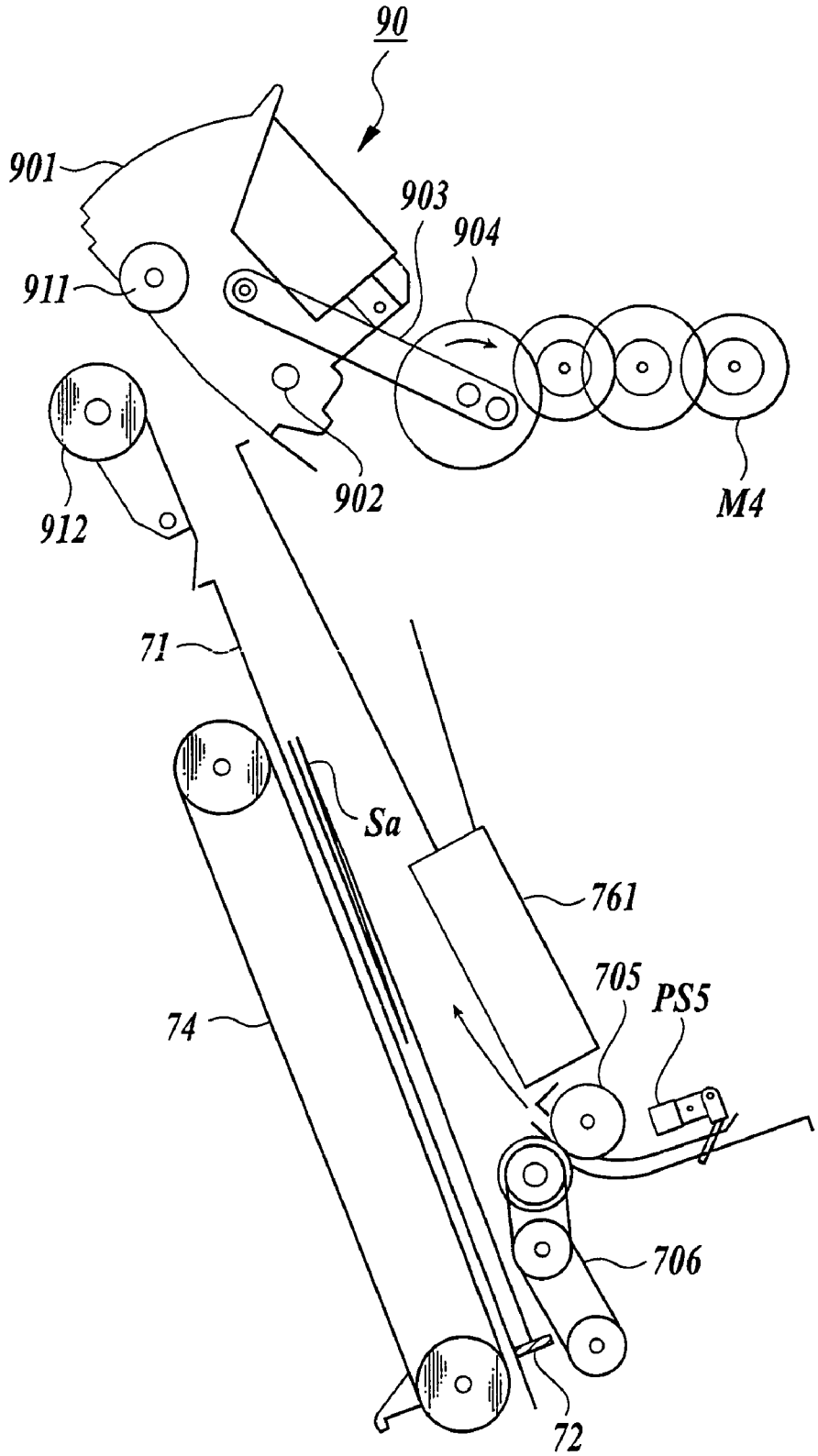
FIG. 13 is a construction view showing a process of opening and closing drive of the sheet ejection section ejecting a stack of sheets made by stapling after Z-folding.

(2) After the width-adjusting is completed, the staplers SP start stapling the stack of sheets Sa by the stapling member 700. At the same time, after the width-adjusting is completed, the motor M4 of the sheet ejection section 90 starts being driven to move the upper roller 911 upward from its nipping position with the lower roller 912. Then, after a predetermined time T2 has passed, the sheet ejection path is made in a half-open state. FIG. 13 shows a waiting state of the sheet ejection path being half-opened.

(3) FIGS. 14A to 15B are construction views showing a process of ejecting the stack of sheets Sa, which is made by stapling after Z-folding, from the sheet ejection section 90. After stapling according to the stapling member 700 is completed, the width-adjusting members 73 are driven to leave for outside of the sheet width. After leaving of the width-adjusting members 73 is completed, the motor M3 for sheet ejection (c.f. FIG. 11) starts being driven to start rotating the lower roller 912 and turning the ejection belt 74. The ejection claw 74A supports the rear end portion of the stack of sheets Sa in the ejection direction, and conveys at a predetermined sheet ejection velocity V1 according to the turning of the ejection belt 74.

Figure 14A:
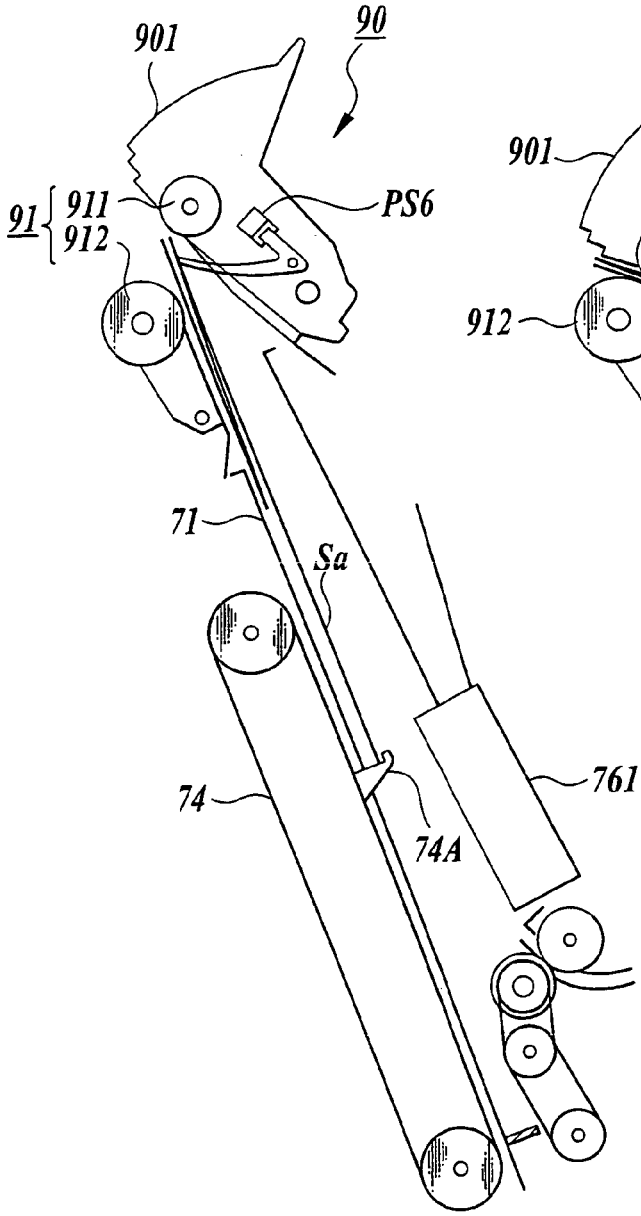
FIG. 14A is a construction view showing a process of opening and closing drive of the sheet ejection section ejecting the stack of sheets made by stapling after Z-folding.

(4) After a predetermined time T3 has passed, the driving of the motor M3 is stopped. At the time of stop, a reverse rotation brake is put on. Thereby, the rotation of the lower roller 912 and the turning of the ejection belt 74 are temporarily stopped. In this temporarily stopped state, the front end portion of the stack of sheets Sa is in a position projecting for approximately 30 mm from the nipping position of the upper roller 911 and the lower roller 912. Further, after a predetermined time T3 has passed, air blowing according to the fan motor 761 is stopped. FIG. 14A is a view schematically showing a state that the front end portion of the stack of sheets Sa is projected into the half-opened sheet ejection path of the sheet ejection section 90 by being stopped temporarily.

(5) After a predetermined time T4 has passed after the motor M3 for sheet ejection is started being driven, the motor M4 for upper roller unit 901 is started being driven, and the upper roller unit 901 is oscillated to close the sheet ejection path of the sheet ejection section 90. At the same time, the electricity of the solenoid SD3 of the sheet ejection section 90 is turned on, and the upper roller 911 is made to press-contact with the lower roller 912 against the urging of the spring.

Figure 14B:
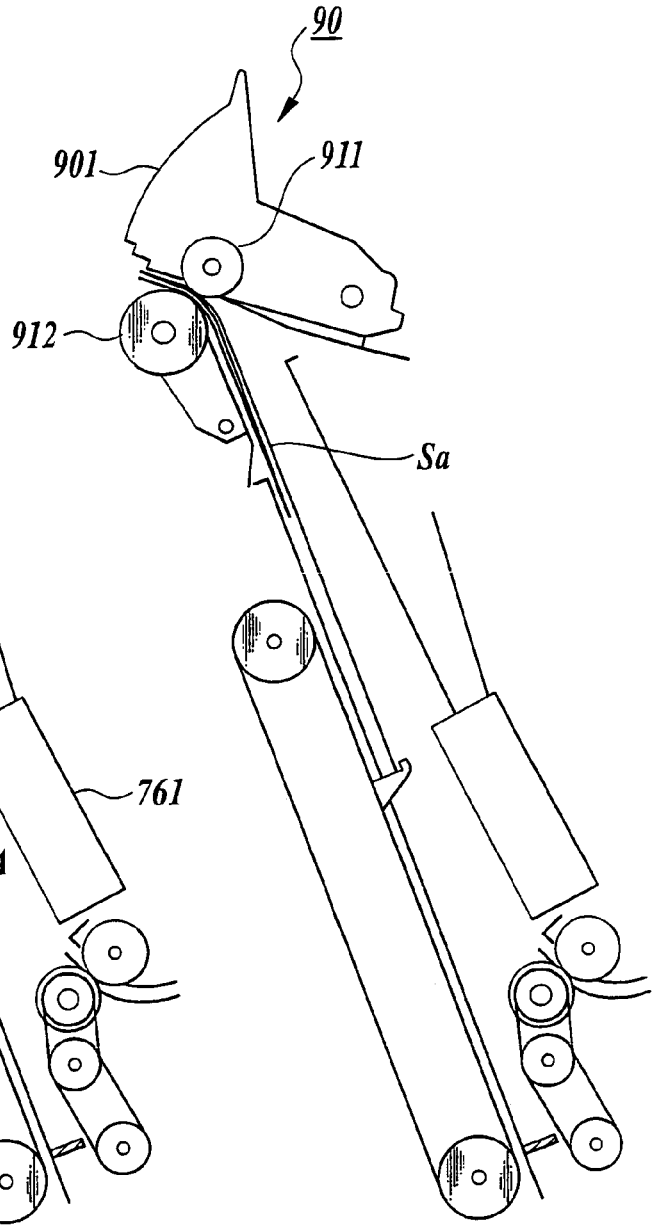
FIG. 14B is a construction view showing a process of opening and closing drive of the sheet ejection section ejecting the stack of sheets made by stapling after Z-folding.

(6) After a predetermined time T5 has passed after the stop of the motor M3, the driving of the motor M4 is stopped. At the same time, the driving of the motor M3 for sheet ejection is restarted, and the rotation of the lower roller 912 and the turning of the ejection belt 74 are started. Then, the stack of sheets Sa is nipped and conveyed by the rotating lower roller 912 and the upper roller 911 rotated by press contacting with the lower roller 912. FIG. 14B is a view schematically showing a state that the stack of sheets Sa is nipped and conveyed by the lower roller 912 and the upper roller 911 along the closed sheet ejection path of the sheet ejection section 90.

Figure 15A:
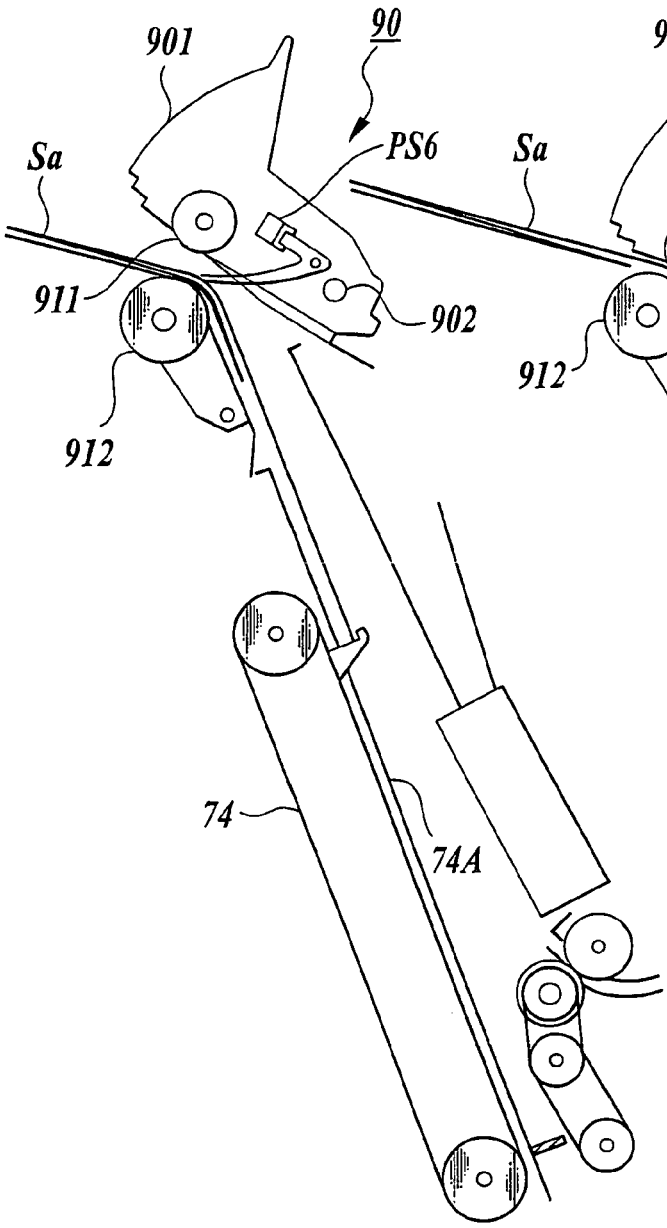
FIG. 15A is a construction view showing a process of opening and closing drive of the sheet ejection section ejecting the stack of sheets made by stapling after Z-folding.

(7) After a predetermined time T6 has passed after the motor M4 is started being driven, the electricity of the solenoid SD3 is turned off to release temporarily the press-contact of the upper roller 911. Since the motor M3 for sheet ejection rotates continuously, the ejection claw 74A of the turning ejection belt 74 continues to press the rear end portion of the stuck of sheets Sa to convey it. The sag of the sheets is released by releasing the press-contact of the upper roller 911, so that the stack of sheets Sa is made flat and conveyed. FIG. 15A shows a state that the stuck of sheets Sa is conveyed by opening temporarily the ejection paired rollers 91.

Figure 15B:
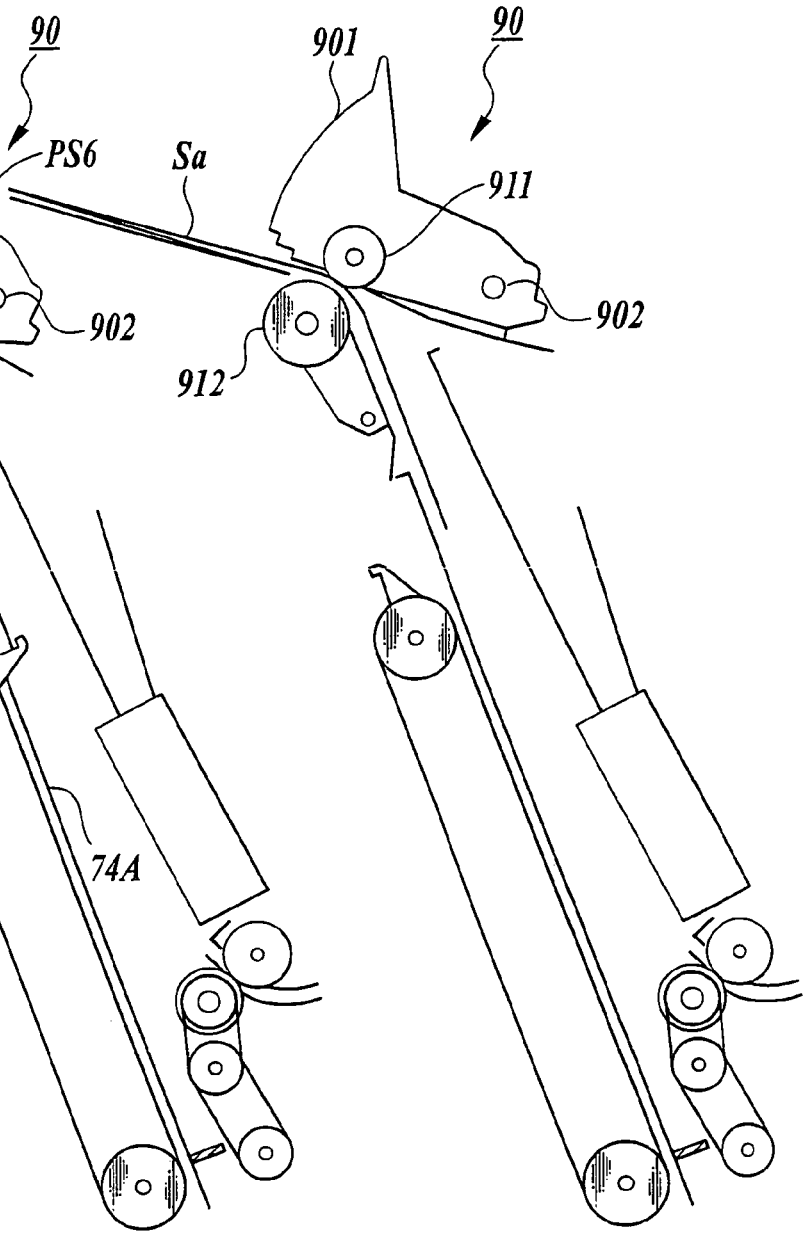
FIG. 15B is a construction view showing a process of opening and closing drive of the sheet ejection section ejecting the stack of sheets made by stapling after Z-folding.

(8) After a predetermined time T7 has passed after the electricity of the solenoid SD3 is turned off, the electricity of the solenoid SD3 is turned on to make the upper roller 911 press-contact with the lower roller 912, which is in the middle of rotation by the motor M3 for sheet ejection, against the urging of the spring, and the stack of sheets Sa is started being conveyed at the sheet ejection velocity V1. FIG. 15B shows a state that the stack of sheets Sa is re-conveyed by making the upper roller 911 press-contact with the lower roller 912. At the time of this re-conveyance, for example, in case of Z-folding and conveying A3 size sheets, the front end portion of the stuck of sheets Sa is in a position projecting for approximately 100 mm from the nipping position of the sheet ejection paired rollers 91.

In addition, the sheet finisher of the embodiment comprises functions for placing the sheet S ejected from the image forming apparatus A, the Z-folded sheet S ejected from the first finisher B, and the cover sheet K or inserting sheet J ejected out from the second finisher C all together on the sheet placing table 71 and adjusting, and thereafter, for stapling and ejecting them.

Thus, the stuck of sheets Sa including Z-folded sheets S is conveyed, adjusted, and stapled in the accumulation section 70, and is ejected from the sheet ejection section 90 to be placed on the up-and-down sheet ejection table 92.

According to the embodiment of the present invention, the following effects can be obtained.

(1) When a Z-folded sheet whose overlapped portion is swollen is placed on the inclined surface of the sheet placing table and a plurality of such Z-folded sheets are stacked, the airflow from the air-blowing member presses against the sheet surface. Thereby, the sheets on the inclined surface can be prevented from being curved, bent or the like by bowing, so that certain sheet conveyance and adjustment can be achieved.

(2) When the Z-folded sheets whose overlapped portion is swollen are conveyed along the sheet placing table after stapled, and nipped and ejected by the ejection paired rollers, the airflow from the air-blowing member presses against the sheet surface. Thereby, since variation in the front end portion of the stuck of sheets, which goes up along the inclined surface, in the ejection direction is reduced to make the sheets flat, the front end portion of the stuck of sheets is nipped and ejected certainly by the rotating ejection paired rollers, so that bad sheet ejection is resolved.

(3) In the embodiment, when the stapled stuck of Z-folded sheets is ejected from the sheet ejection section by supporting it by the ejection claw along the sheet placing table, the ejection paired rollers comprising the driving roller and the driven roller is made to wait in a half-open state, and after the front end portion of the stuck of sheets in the sheet ejection direction reaches the ejection paired rollers, the sheet conveyance is stopped temporarily. Then, the ejection paired rollers are made to press-contact with each other to press-contact and nip the stuck of sheets by the ejection paired rollers. Thereafter, during ejecting the stuck of sheets, the press-contact of the driven roller is once released to release the sag of the stuck of sheets. Thereafter, the driven roller is controlled to press-contact with the driving roller to eject the stuck of sheets. Thereby, accidents such that buckling is generated in the vicinity of the rear end portion of the stuck of sheets by the front end portion of the stuck of sheets hitting the construction members of the sheet ejection section and the rear end portion of the stuck of sheets being pushed up by the proceeding ejection claw, and moreover, that tear or wrinkle is generated in the sheets in the vicinity of the stapled portion in the vicinity of the rear end portion of the stuck of sheets, can be prevented.

(4) Further, the mixed stuck of sheets including Z-folded sheets is conveyed, adjusted, and stapled in the accumulation section to be ejected certainly from the sheet ejection section.

In the above, the embodiment of the present invention is explained. However, it is needless to say that the present invention is not limited to such embodiment, but various modifications are possible in a range within the scope of the present invention. For example, in the finisher in the embodiment of the present invention, the image forming system comprising the image forming apparatus A, the first finisher B, and the second finisher C is described. However, the present invention can be applied to a first finisher B connected to an image forming apparatus A or a second finisher C connected to an image forming apparatus A, or a single first finisher B or a single second finisher C, or the like. Further, in the above-described embodiment, Z-folded sheets are mainly explained. However, the present invention is not limited to this. For example, it can be applied to sheets to which folding, such as two-folding, three-folding or the like, or punching holes is performed, or to sheets simply ejected from the first finisher B, or the like.

The entire disclosure of Japanese Patent Application No. 2002-044436 filed on Feb. 21, 2002, Japanese Patent Application No. 2002-053365 filed on Feb. 28, 2002, including specification, claims, drawings and summary are incorporated herein by reference in its entirety.

What is claimed is:

1. A sheet finisher comprising:

a conveyance member for conveying a sheet to an ejection direction;

a sheet ejection section having paired rollers, for ejecting the conveyed sheet by nipping the sheet by the paired rollers; and a control section for controlling the conveyance member and the sheet ejection section to separate the paired rollers from each other when conveying the sheet, and after a front end portion of the sheet in the ejection direction passes a nipping position of the paired rollers, make the paired rollers press-contact with each other, nip and re-convey the sheet, and eject the sheet out of the finisher, wherein the control section further controls the conveyance member and the sheet ejection section to temporarily release the press-contact of the paired rollers during reconveyance of the sheet, to remove a sag from the sheet, to then make the paired rollers press-contact with each other again, and to eject the sheet out of the finisher by nipping the sheet.

2. The sheet finisher as defined by claim 1, wherein the paired rollers comprise a first roller for rotating by being connected to a driving source, and a second roller for rotating by press-contacting with the first roller.

3. The sheet finisher as defined by claim 2, wherein the second roller is driven by a press-contact drive mechanism so as to be capable of contacting with and separating from the first roller side to press-contact and release the sheet.

4. The sheet finisher as defined by claim 1, further comprising:

a sheet placing member for placing and adjusting a predetermined number of sheets to which a predetermined processing is carried out thereon; and a stapling member for stapling the predetermined number of the adjusted sheets, wherein the stapled sheets are conveyed to the ejection direction along the sheet placing member by the conveyance member.

5. The sheet finisher as defined by claim 4, wherein an image is formed on the sheets before the predetermined processing is performed.

6. The sheet finisher as defined by claim 4, wherein the predetermined processing is a finishing processing including punching holes, two-folding, Z-folding and three-folding.

7. The sheet finisher as defined by claim 4, wherein the stapling includes end-stapling and midway stapling.

8. The sheet finisher as defined by claim 7, wherein when the midway stapling is performed to the sheets, midway folding is performed to the sheets after the midway stapling is performed.

9. The sheet finisher as defined by claim 4, wherein the sheet placing member comprises an inclined surface, and the sheets are placed on the inclined surface.

10. The sheet finisher as defined by claim 1, wherein a position of the sheet to temporarily stop is a position such that a front end portion of the sheet in the ejection direction is projected more forward than the nipping position of the sheet of the paired rollers in the sheet ejection direction.

11. A sheet processing apparatus comprising:

a sheet folding apparatus for carrying out a predetermined processing to a sheet; and the sheet finisher of claim 1 for conveying the sheet ejected from the sheet folding apparatus to the ejection direction, to which the predetermined processing is carried out.

12. An image forming system comprising;

an image forming apparatus for forming an image on a sheet;

a sheet folding apparatus for carrying out a predetermined processing on the sheet formed with the image, which is ejected from the image forming apparatus; and the sheet finisher of claim 1 for conveying the sheet ejected out from the sheet folding apparatus to the ejection direction, to which the predetermined processing is carried out.

13. A sheet finishing method comprising:

conveying a sheet to an ejection direction; and ejecting the conveyed sheet by nipping the conveyed sheet by paired rollers, wherein the paired rollers are separated from each other when the sheet is conveyed, and after a front end portion of the sheet in the ejection direction passes a nipping position of the paired rollers, and the paired rollers are press-contacted with each other, and the sheet is nipped to be re-conveyed and ejected, and wherein ejecting the conveyed sheet includes temporarily releasing the paired rollers during re-conveyance of the sheet to remove a sag from the sheet, by press-contacting the paired rollers with each other again during the conveyance, and by nipping the sheet.

14. The sheet finishing method as defined by claim 13, further comprising the steps of:

placing and adjusting a predetermined number of sheets to which a predetermined processing is carried out on a sheet placing member; and stapling the predetermined number of the adjusted sheets, wherein the stapled sheets are conveyed to the ejection direction along the sheet placing member.

15. The sheet finishing method as defined by claim 14, further comprising the step of:

forming an image on the sheet before the predetermined processing is carried out.

16. The sheet finishing method as defined by claim 14, wherein the predetermined processing is a finishing, processing including punching holes, two-folding, Z-folding and three-folding.

17. The sheet finishing method as defined by claim 14, wherein the stapling includes end-stapling and midway stapling.

18. The sheet finishing method as defined by claim 17, wherein when the midway stapling is performed to the sheets, midway folding is performed to the sheets after the midway stapling is performed.

19. The sheet finishing method as defined by claim 14, wherein the sheet placing member comprises an inclined surface, and the sheets are placed on the inclined surface.

20. A sheet processing method comprising the steps of:

carrying out a predetermined processing to a sheet; and conveying the sheet to which the predetermined processing is carried out to an ejection direction, according to the sheet finishing method of claim 13.

21. An image forming method comprising the steps of:

forming an image on a sheet;

carrying out a predetermined processing to the sheet formed with the image; and conveying the sheet to which the predetermined processing is carried out to an ejection direction, according to the sheet finishing method of claim 13.

* * * * *